US007939233B2

(12) United States Patent
Inoue et al.

(10) Patent No.: US 7,939,233 B2
(45) Date of Patent: May 10, 2011

(54) MAGNETIC CARRIER AND TWO-COMPONENT DEVELOPER

(75) Inventors: Chika Inoue, Berlin (DE); Hiroyuki Fujikawa, Yokohama (JP); Koh Ishigami, Mishima (JP); Kunihiko Nakamura, Gotemba (JP); Nozomu Komatsu, Mishima (JP); Tomoko Endo, Odawara (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/691,033

(22) Filed: Jan. 21, 2010

(65) Prior Publication Data

US 2010/0119967 A1 May 13, 2010

Related U.S. Application Data

(63) Continuation of application No. PCT/JP2009/064091, filed on Aug. 4, 2009.

(30) Foreign Application Priority Data

Aug. 4, 2008 (JP) ..... 2008-201072

(51) Int. Cl.
*G03G 9/00* (2006.01)

(52) U.S. Cl. ..... 430/111.3; 430/111.35; 430/111.4

(58) Field of Classification Search ..... 430/111.3, 430/111.35, 111.4
See application file for complete search history.

(56) References Cited

U.S. PATENT DOCUMENTS

| | | | | |
|---|---|---|---|---|
| 7,566,519 | B2 | 7/2009 | Kobayashi et al. | 430/111.35 |
| 2006/0269862 | A1 | 11/2006 | Kobayashi et al. | 430/111.31 |
| 2009/0047592 | A1 | 2/2009 | Okamoto et al. | 430/109.3 |

FOREIGN PATENT DOCUMENTS

| | | |
|---|---|---|
| JP | 58-216260 | 12/1983 |
| JP | 04-093954 | 3/1992 |
| JP | 08-254857 | 10/1996 |
| JP | 2004-077568 | 3/2004 |
| JP | 2006-337579 | 12/2006 |
| JP | 2007-057943 | 3/2007 |
| JP | 2007-072444 | 3/2007 |
| WO | WO 2007/138912 A1 | 12/2007 |

*Primary Examiner* — Mark A Chapman
(74) *Attorney, Agent, or Firm* — Fitzpatrick, Cella, Harper & Scinto

(57) ABSTRACT

A magnetic carrier and a two-component developer are provided which have remedied blank areas, fog after leaving, carrier sticking during running, and image density variations before and after running. The magnetic carrier has magnetic carrier particles having at least porous magnetic core particles and a resin. The magnetic carrier particles satisfying the specific conditions (a), (b) and (c) where, in a reflected electron image of cross sections of the magnetic carrier particles as photographed with a scanning electron microscope, straight lines that divide a cross section of a magnetic carrier particle into 72 at intervals of 5° are drawn from a reference point of the cross section thereof toward the surface of the magnetic carrier particle; the magnetic carrier particles being contained in an amount of 60% by number or more.

6 Claims, 4 Drawing Sheets

MAGNETIC CARRIER AND TWO-COMPONENT DEVELOPER

CROSS-REFERENCE TO RELATED APPLICATIONS

This application is a continuation of International Application No. PCT/JP2009/064091, filed Aug. 4, 2009, which claims the benefit of Japanese Patent Application No. 2008-201072, filed Aug. 4, 2008.

BACKGROUND OF THE INVENTION

1. Field of the Invention

This invention relates to a magnetic carrier and a two-component developer which are used in an electrophotographic system, an electrostatic recording system or an electrostatic printing system.

2. Description of the Related Art

In recent years, in order to achieve high image quality and high running performance which are required in electrophotography and so forth, a resin-filled carrier is proposed in which the ferrite core material having pores is filled with a resin (see Japanese Patent Laid-open Applications No. 2007-57943 and No. 2006-337579). According to these proposals, the carrier can be made low in specific gravity and this can keep, to a certain extent, inferior images from being formed.

However, in a system making use of an a-Si drum in order to achieve the high running performance, the a-Si drum has a higher electrostatic capacity than any OPC drum, and hence a toner must be more triboelectrically charged than ever. Such a carrier, however, have had an insufficient triboelectric charge-providing ability, and hence, where images are printed after leaving for a week in a high-temperature and high-humidity environment (temperature 30° C./humidity 80% RH), the toner may stick to non-image areas to cause a phenomenon of the formation of inferior images (i.e., fog). Hence, it has been difficult in some cases to apply such a carrier to the system making use of an a-Si drum. Furthermore, where images are printed on 50,000 sheets at a low image density in an image percentage of 1%, any broken carrier particles may stick to images on a photosensitive drum (carrier sticking).

In addition, in order to achieve the high image quality it is necessary to keep a phenomenon (ring marks) from occurring in which ring-like or spot-like patterns appear on recording sheets. The ring marks concern a phenomenon which comes about because any low-resistance foreign matter is present on a developer carrying member to cause the leaking of electric charges from the developer carrying member to the photosensitive drum. To prevent it, the peak-to-peak voltage (Vpp) of an alternating bias must be set low. However, it has turned out that, if the Vpp is set low in using the carrier disclosed in Japanese Patent Laid-open Applications No. 2007-57943 and No. 2006-337579, a low developing performance may result to cause a decrease in image density. It has further come about that the toner at the rear end of a halftone area is scraped off at the boundary between the halftone area and a solid area to make white lines, to cause image defects (blank areas) in which edges of solid areas stand emphasized.

Meanwhile, a carrier is proposed which is obtained by forming, in a supercritical fluid, coat layers on ferrite cores in the state a resin is dissolved or dispersed, so as to make the resin small in standard deviation of its layer thickness (see Japanese Patent Laid-open Application No. 2007-72444). The use of this carrier enables formation of high-density images in an image forming apparatus having a process speed of about 200 mm/sec. However, in a high-speed machine having, e.g., a process speed of 300 mm/sec or more, which is adaptable to POD (print on-demand), there has been a problem that the blank areas occur because of an insufficient developing efficiency. In such a high-speed machine having a process speed of 300 mm/sec or more, it has also come about in some cases that, where images are printed on 50,000 sheets in an image percentage of 1%, the resin layers at the surfaces of such magnetic carrier particles deteriorate to cause variations in image density before and after running.

Also proposed are a carrier the ferrite cores of which have been so coated with a resin as to have surface unevenness coming from fine crystal particles, and a carrier the ferrite cores of which have been incorporated with a resin only at their concavities (see Japanese Patent Laid-open Applications No. H04-93954 and No. S58-216260). According to these Japanese Patent Laid-open Applications No. H04-93954 and No. S58-216260, carriers can be obtained which have been improved in environmental dependency and toner-spent resistance to a certain extent. However, the layer thickness of the resin is not controlled, and hence there has been a problem that, in a normal-temperature and low-humidity environment (temperature 23° C./humidity 5% RH), the blank areas occur because of a lowering of developing efficiency when the Vpp is set low.

SUMMARY OF THE INVENTION

An object of the present invention is to provide a magnetic carrier and a two-component developer which have resolved the problems discussed as above. Stated specifically, an object of the present invention is to provide a magnetic carrier and a two-component developer which have remedied blank areas, fog after leaving, carrier sticking during running, and image density variations before and after running.

The present invention is a magnetic carrier which has magnetic carrier particles having at least porous magnetic core particles and a resin; the magnetic carrier particles satisfying the following (a), (b) and (c) where, in a reflected electron image of cross sections of the magnetic carrier particles as photographed with a scanning electron microscope, straight lines that divide a cross section of a magnetic carrier particle into 72 at intervals of 5° are drawn from a reference point of the cross section thereof toward the surface of the magnetic carrier particle; the magnetic carrier particles being contained in an amount of 60% by number or more:

(a) the number A of straight lines along which the resin is in a thickness of from 0.0 μm or more to 0.3 μm or less as found by measuring the distance from the surface of the magnetic carrier particle to the surface of a porous magnetic core particle on the straight lines is from 7 lines or more to 36 lines or less, based on 72 lines in total number of the straight lines;

(b) the number B of straight lines along which the resin is in a thickness of from 1.5 μm or more to 5.0 μm or less as found by measuring the distance from the surface of the magnetic carrier particle to the surface of the porous magnetic core particle on the straight lines is from 7 lines or more to 36 lines or less, based on 72 lines in total number of the straight lines; and (c) the number C of straight lines along which the resin is in a thickness of from 0.0 μm or more to 5.0 μm or less as found by measuring the distance from the surface of the magnetic carrier particle to the surface of the porous magnetic core particle on the straight lines is from 70 lines or more, based on 72 lines in total number of the straight lines.

The use of the magnetic carrier and two-component developer of the present invention enables sufficient remedy for blank areas, fog after leaving, and carrier sticking during running, and also lessens image density variations before and after running.

Furthermore features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The magnetic carrier of the present invention is a magnetic carrier which has magnetic carrier particles having at least porous magnetic core particles and a resin.

Figure 4:
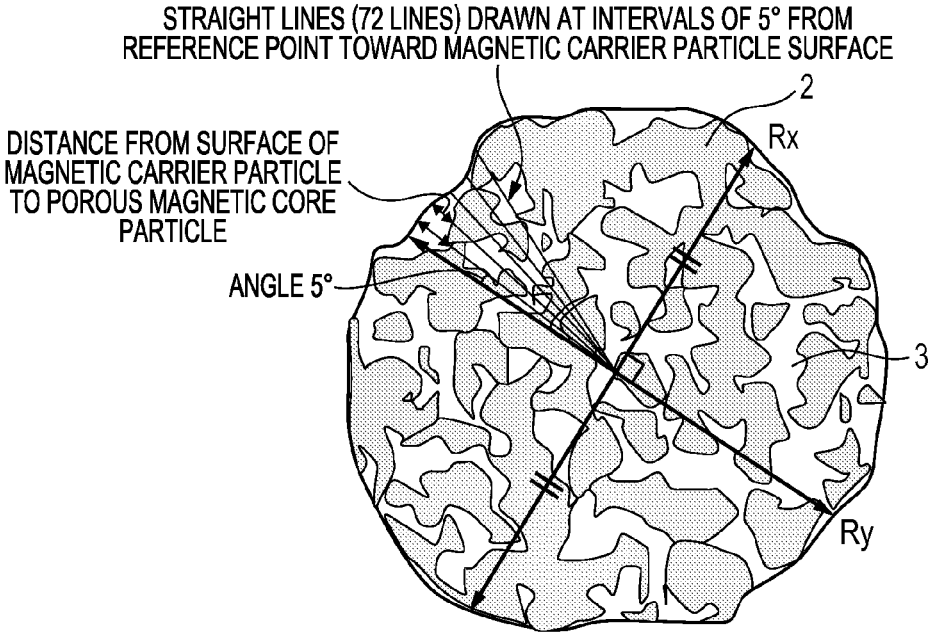
FIG. 4 is a view diagrammatically showing an example of the measurement of the resin thickness found by measuring the distance from the surface of a magnetic carrier particle to the surface of a porous magnetic core particle in the present invention.

In the magnetic carrier of the present invention, it is important that, where, in a reflected electron image of cross sections of the magnetic carrier particles as photographed with a scanning electron microscope, straight lines that divide a cross section of a magnetic carrier particle into 72 at intervals of 5° are drawn from a reference point of the cross section thereof toward the surface of the magnetic carrier particle as also shown in FIG. 4 referred to later, the number A of straight lines along which the resin is in a thickness of from 0.0 μm or more to 0.3 μm or less as found by measuring the distance from the surface of the magnetic carrier particle to the surface of a porous magnetic core particle on the straight lines is from 7 lines or more to 36 lines or less, based on 72 lines in total number of the straight lines. It is also important that the number B of straight lines along which the resin is in a thickness of from 1.5 μm or more to 5.0 μm or less as found by measuring the distance from the surface of the magnetic carrier particle to the surface of the porous magnetic core particle on the straight lines is from 7 lines or more to 36 lines or less, based on 72 lines in total number of the straight lines.

The number A of straight lines and the number B of straight lines are controlled within the above ranges based on the total number of the straight lines, and this can prevent blank areas, fog in the case of printing after leaving for a week in a high-temperature and high-humidity environment (30° C./80% RH), and carrier sticking during running, and also can lessen image density variations before and after running.

The reason why the magnetic carrier of the present invention brings out such superior effects is unclear, and the present inventors presume it as stated below.

That the magnetic carrier particles have the part where the resin is in a thickness of from 0.0 μm or more to 0.3 μm or less as found by measuring the distance from the surface of the magnetic carrier particle to the surface of the porous magnetic core particle on the straight lines means that the distance from the surface of the magnetic carrier particle to the surface of the porous magnetic core particle is short and the carrier particles have the part where the resin is small in thickness at their surfaces. In the case when the magnetic carrier particles have the part where the resin is in a thickness of 0.3 μm or less at their surfaces, the porous magnetic core particles have a low resistance value, and hence triboelectric charges (counter electric charges) having a polarity reverse to that of a toner the magnetic carrier comes to carry at the time of development can readily be released to the developer carrying member. Hence, the electrostatic attraction between the magnetic carrier and the toner is weakened, so that the toner can be improved in its response to the electric field and improved in its developing performance.

However, if the magnetic carrier particles are only those having at their surfaces the part where the resin is in a thickness of from 0.0 μm or more to 0.3 μm or less as found by measuring the distance from the surface of the magnetic carrier particle to the surface of the porous magnetic core particle, the toner may be improved in developing performance but does not come into the remedy of blank areas and fog in some cases.

In order to remedy blank areas and fog, in addition to the feature of having the part where the resin is small in thickness, it is important to control the proportion of the part where the resin is small in thickness to the whole, at the surfaces of the magnetic carrier particles. Stated specifically, it is important that the number A of straight lines along which the resin is in a thickness of from 0.0 μm or more to 0.3 μm or less as found by measuring the distance from the surface of the magnetic carrier particle to the surface of the porous magnetic core particle on the straight lines is from 7 lines or more to 36 lines or less, based on 72 lines in total number of the straight lines. Furthermore, the number A of straight lines may preferably be from 11 lines or more to 32 lines or less.

Inasmuch as the number A of straight lines is so controlled as to be from 7 lines or more to 36 lines or less, the triboelectric charges (counter electric charges) having a polarity reverse to that of the toner the magnetic carrier comes to carry at the time of development can readily be released to the developer carrying member in a normal-temperature and low-humidity environment (temperature 23° C./humidity 5% RH), and the toner can have a superior developing performance and can promise less blank areas.

Furthermore, resin portions which come into contact with the toner and provide the toner with triboelectric charges are appropriately present on the surfaces of the magnetic carrier particles. Hence, the toner is appropriately triboelectrically charged, and hence the fog can be kept from occurring even where images are printed after leaving for a week in a high-temperature and high-humidity environment (temperature 30° C./humidity 80% RH).

That the number A of straight lines is less than 7 lines shows that there is few part where the resin is in a small thickness as found by measuring the distance from the surface of the magnetic carrier particle to the surface of the porous magnetic core particle. In such a case, the triboelectric charges (counter electric charges) having a polarity reverse to that of the toner the magnetic carrier comes to carry at the time of development can not easily be released to the developer carrying member, and, where, e.g., images are printed at a Vpp set low and using a high-speed machine having a process speed of 300 mm/sec or more in a normal-temperature and low-humidity environment (temperature 23° C./humidity 5% RH), the toner may have a low developing performance and hence makes blank areas tend to occur.

On the other hand, that the number A of straight lines is more than 36 lines shows that there are many parts where the resin is in a small thickness as found by measuring the distance from the surface of the magnetic carrier particle to the surface of the porous magnetic core particle. Resin portions with a thickness which are present on the surfaces of the magnetic carrier particles come into contact with the toner to provide the toner with triboelectric charges. Accordingly, since the resin portions with a thickness which are present on the surfaces of the magnetic carrier particles are so few that the toner can not sufficiently triboelectrically be charged, the toner may have an insufficient triboelectric charge quantity, so that the fog tends to occur where, e.g., images are printed after leaving for a week in a high-temperature and high-humidity environment (temperature 30° C./humidity 80% RH).

Meanwhile, that the magnetic carrier particles have the part where the resin is in a thickness of from 1.5 μm or more to 5.0 μm or less as found by measuring the distance from the surface of the magnetic carrier particle to the surface of the porous magnetic core particle on the straight lines means that the magnetic carrier particles have the part where the resin is large in thickness at their surfaces. In the case when the magnetic carrier particles have the part where the resin is in a thickness of from 1.5 μm or more to 5.0 μm or less at their surfaces, the magnetic carrier can be improved in strength and can be improved in durability when images are printed at a low image density.

However, if the magnetic carrier particles are only those having at their surfaces the part where the resin is in a thickness of from 1.5 μm or more to 5.0 μm or less as found by measuring the distance from the surface of the magnetic carrier particle to the surface of the porous magnetic core particle, any magnetic carrier coming from broken magnetic carrier particles may come to stick onto toner images (carrier sticking) where images are printed on a large number of sheets, or may be insufficient in preventing the image density variations before and after running.

Accordingly, it is important to control the proportion of the part where the resin is large in thickness to the whole, at the surfaces of the magnetic carrier particles. Stated specifically, it is important that the number B of straight lines along which the resin is in a thickness of from 1.5 μm or more to 5.0 μm or less as found by measuring the distance from the surface of the magnetic carrier particle to the surface of the porous magnetic core particle is from 7 lines or more to 36 lines or less, based on 72 lines in total number of the straight lines. Furthermore, the number B of straight lines may preferably be from 11 lines or more to 32 lines or less.

Inasmuch as the number B of straight lines is so controlled as to be from 7 lines or more to 36 lines or less, the magnetic carrier particles are sufficiently covered with the resin, and hence the magnetic carrier particles can have a sufficient strength, and can not easily come broken. Accordingly, even where images are printed on 50,000 sheets at a low image density, any magnetic carrier coming from broken magnetic carrier particles can not easily come to stick onto toner images (carrier sticking).

Furthermore, even where images with an image area of 1% are printed on 5,000 sheets, the resin may less deteriorate to enable the toner to less change in triboelectric charge quantity, and hence this can lessen the image density variations before and after running.

That the number B of straight lines is less than 7 lines shows that there is few part where the resin is in a large thickness as found by measuring the distance from the surface of the magnetic carrier particle to the surface of the porous magnetic core particle. Accordingly, the porous magnetic core particles may have a low strength and tend to come broken. Hence, any magnetic carrier coming from broken magnetic carrier particles may come to stick onto toner images (carrier sticking) where images are printed on a large number of sheets.

On the other hand, that the number B of straight lines is more than 36 lines shows that there are many parts where the resin is in a large thickness as found by measuring the distance from the surface of the magnetic carrier particle to the surface of the porous magnetic core particle. Accordingly, where images with an image area of 1% are printed on 5,000 sheets, the resin may deteriorate to make the toner change greatly in triboelectric charge quantity, and hence this may make great the image density variations before and after running.

That the number A of straight lines is from 7 lines or more to 36 lines or less and the number B of straight lines is from 7 lines or more to 36 lines or less, both based on 72 lines in total number of the straight lines, shows that the magnetic carrier particles have both the part where the resin is in a small thickness (the number A of straight lines) and the part where the resin is in a large thickness (the number B of straight lines) as found by measuring the distance from the surface of the magnetic carrier particle to the surface of the porous magnetic core particle. Inasmuch as the magnetic carrier particles simultaneously have, within the above ranges, the number A of straight lines along which the resin is in a thickness of from 0.0 μm or more to 0.3 μm or less and the number B of straight lines along which the resin is in a thickness of from 1.5 μm or more to 5.0 μm or less, this can well remedy the blank areas, the fog after leaving and the carrier sticking during running, and also can well lessen the image density variations before and after running.

In addition, inasmuch as the magnetic carrier particles simultaneously have, within the above ranges, the number A of straight lines along which the resin is in a thickness of from 0.0 μm or more to 0.3 μm or less as found by measuring the distance from the surface of the magnetic carrier particle to the surface of the porous magnetic core particle and the number B of straight lines along which the resin is in a thickness of from 1.5 μm or more to 5.0 μm or less as found by measuring the distance from the surface of the magnetic carrier particle to the surface of the porous magnetic core particle, the magnetic carrier of the present invention can bring out a high developing efficiency, and hence can overcome the above problems even when the Vpp is set low. Hence, image difficulties such as ring marks and blank areas can not easily occur. To control the above A and B within the ranges specified in the present invention, it is achievable by controlling how to fill the core particles with the resin, how to coat the former with the latter and the amount of the resin when the magnetic carrier is produced.

If the magnetic carrier particles have many parts where the resin is in a thickness of more than 5.0 μm, the magnetic carrier particles may come to coalesce when the magnetic carrier is produced, because the resin portions are too thick. Accordingly, in the magnetic carrier particles in the present invention, the number C of straight lines along which the resin is in a thickness of from 0.0 μm or more to 5.0 μm or less as found by measuring the distance from the surface of the magnetic carrier particle to the surface of the porous magnetic core particle on the straight lines is from 70 lines or more, based on 72 lines in total number of the straight lines.

Furthermore, in the present invention, the magnetic carrier particles in which the numbers A, B and C of straight lines satisfy the ranges specified in the present invention are present in an amount of 60% by number or more of the whole magnetic carrier. Such particles may also preferably be present in an amount of 80% by number or more, and much preferably 96% by number or more, of the whole. Thus, the magnetic carrier particles the resin thickness of which has been controlled can be in a large quantity, and hence this can remedy the fog after leaving.

Figure 5:
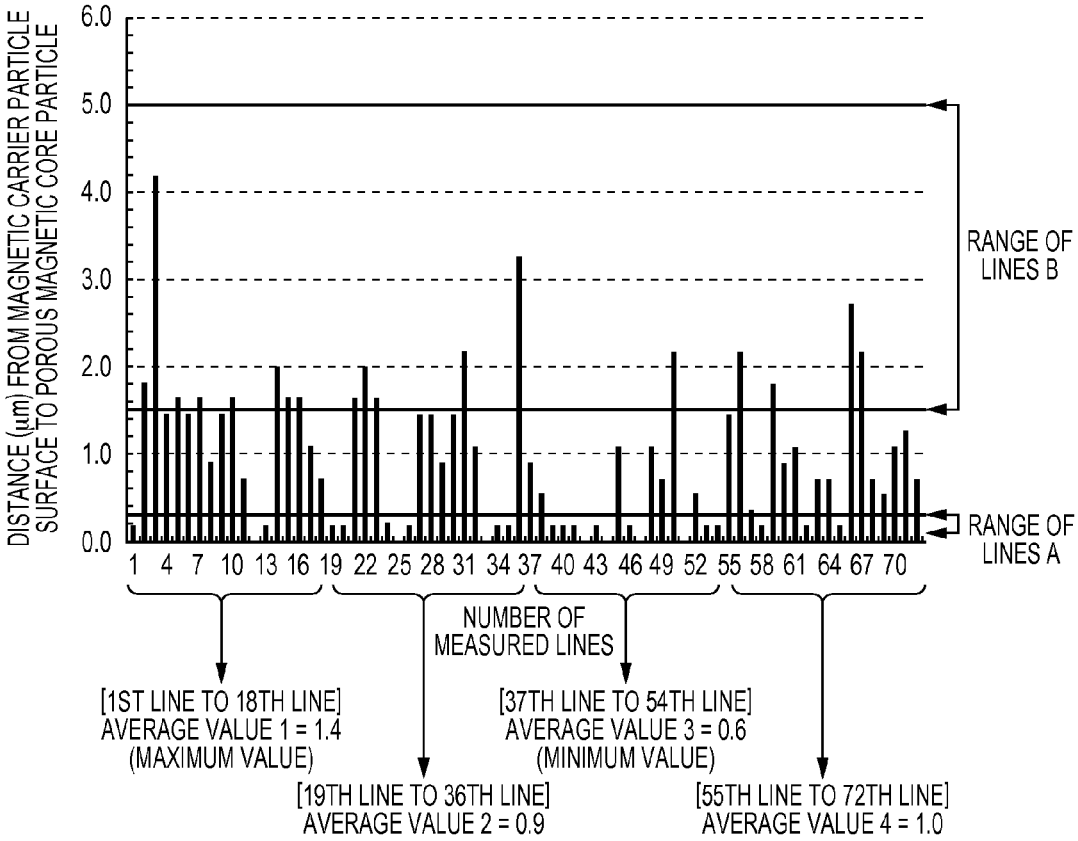
FIG. 5 is a graph of the resin thickness found by measuring the distance from the surface of a magnetic carrier particle to the surface of a porous magnetic core particle in Example 1 in the present invention.

Furthermore, in the magnetic carrier of the present invention, where an average value of the resin thickness along straight lines of from the 1st line to the 18th line among the above straight lines is set as an average value (1), an average value of the resin thickness along straight lines of from the 19th line to the 36th line among the above straight lines is set as an average value (2), an average value of the resin thickness along straight lines of from the 37th line to the 54th line among the above straight lines is set as an average value (3) and an average value of the resin thickness along straight lines of from the 55th line to the 72nd line among the above straight lines is set as an average value (4), it is preferable that a difference between the maximum value and the minimum value in these average values (1) to (4) is 1.5 μm or less. FIG. 5 shows such data specifically in the form of a graph in respect of the magnetic carrier of Example 1 given later.

That the difference between the maximum value and the minimum value in these average values (1) to (4) is 1.5 μm or less shows that the part where the resin is small in thickness and the part where the resin is large in thickness as found by measuring the distance from the surface of the magnetic carrier particle to the surface of the porous magnetic core particle stand not localized. Hence, the toner is triboelectrically charged less non-uniformly at every areas of the surface of each magnetic carrier particle, and hence the fog after leaving can be more kept from occurring.

Furthermore, in the magnetic carrier of the present invention, it is preferable that the resin thickness found by measuring the distance from the surface of the magnetic carrier particle to the surface of the porous magnetic core particle is in a standard deviation of from 0.3 μm or more to 1.5 μm or less. This promises the presence of both the part where the resin is small in thickness and the part where the resin is large in thickness, and hence this can more keep the fog after leaving from occurring and also can more lessen the carrier sticking during running.

Porous magnetic cores are described next. In the present invention, the "porous magnetic cores" mean an aggregate of a large number of porous magnetic core particles. It is important for the porous magnetic core particles to have pores which extend from the surfaces to the interiors of the magnetic carrier particles. The pores are filled with the resin, and this enables the magnetic carrier to have a high strength and also provide the toner with a high developing performance.

As a material for the porous magnetic core particles, it may include magnetite and ferrite. It may preferably be ferrite. The ferrite is a sintered body represented by the following formula: $(M1_2O)_x(M2O)_y(Fe_2O_3)_z$ (wherein M1 is a monovalent metal and M2 is a divalent metal; and, where $x+y+z=1.0$, x and y are each $0 \leqq (x,y) \leqq 0.8$, and z is $0.2<z<1.0$.).

In the formula, as the M1 and M2, it is preferable to use at least one kind of metallic element selected from the group consisting of Li, Fe, Mn, Mg, Sr, Cu, Zn, Ni, Co and Ca.

It may include magnetic Li type ferrites [e.g., $(Li_2O)_a(Fe_2O_3)_b$ ($0.0<a<0.4$, $0.6 \leqq b<1.0$, and $a+b=1$), and $(Li_2O)_a(SrO)_b(Fe_2O_3)_c$ ($0.0<a<0.4$, $0.0<b<0.2$, $0.4 \leqq c<1.0$, and $a+b+c=1$)]; Mn type ferrites [e.g., $(MnO)_a(Fe_2O_3)_b$ ($0.0<a<0.5$, $0.5 \leqq b<1.0$, and $a+b=1$); Mn—Mg type ferrites [e.g., $(MnO)_a(MgO)_b(Fe_2O_3)_c$ ($0.0<a<0.5$, $0.0<b<0.5$, $0.5 \leqq c<1.0$, and $a+b+c=1$)]; Mn—Mg—Sr type ferrites [e.g., $(MnO)_a(MgO)_b(SrO)_c(Fe_2O_3)_d$ ($0.0<a<0.5$, $0.0<b<0.5$, $0.0<c<0.5$, $0.5 \leqq d<1.0$, and $a+b+c+d=1$)]; and Cu—Zn type ferrites [e.g., $(CuO)_a(ZnO)_b(Fe_2O_3)_c$ ($0.0<a<0.5$, $0.0<b<0.5$, $0.5 \leqq c<1.0$, and $a+b+c=1$)]. The above ferrites may contain any other metal in a very small quantity.

In order to make favorable the porous structure and the state of unevenness of core particle surfaces, the Mn type ferrites, the Mn—Mg type ferrites and the Mn—Mg—Sr type ferrites, which contain the Mn element, are preferred from the viewpoint of advantages that the rate of growth of ferrite particles can readily be controlled and the specific resistance of porous magnetic cores can favorably be controlled.

Production steps where ferrite is used as the porous magnetic cores are described below in detail.

Step 1 (Weighing and Mixing Step)

Ferrite raw materials weighed out are put into a mixing machine, and are pulverized and mixed for 0.1 hour or more to 20.0 hours or less. The ferrite raw materials may include the following: Metallic particles of Li, Fe, Zn, Ni, Mn, Mg, Co, Cu, Ba, Sr, Y, Ca, Si, V, Bi, In, Ta, Zr, B, Mo, Na, Sn, Ti, Cr, Al or rare earth elements, oxides of metallic elements, hydroxides of metallic elements, oxalates of metallic elements, and carbonates of metallic elements. The mixing machine may include the following: A ball mill, a satellite mill, Giotto mill and a vibration mill. In particular, the ball mill is preferred from the viewpoint of mixing performance.

Step 2 (Provisional Baking Step)

The ferrite raw materials thus mixed are provisionally baked in the atmosphere and at a baking temperature in the range of from 700° C. or more to 1,000° C. or less for from 0.5 hour or more to 5.0 hours or less in the atmosphere to make the raw materials into ferrite. For the baking, the following furnace may be used, for example: A burner type baking furnace, a rotary type baking furnace, or an electric furnace.

Step 3 (Grinding Step)

The provisionally baked ferrite produced in the step 2 is ground by means of a grinder. As the grinder, there are no particular limitations thereon as long as the desired particle diameter can be attained, and the following may be used, for example: A crusher, a hammer mill, a ball mill, a bead mill, a satellite mill, or Giotto mill. The ball mill and the bead mill are preferred from the viewpoint of an advantage that the grinding time can be short. Also, a wet process can achieve a higher grinding efficiency than a dry process because the ground product does not fly up in the mill. Thus, the wet process is preferred to the dry process.

Step 4 (Granulation Step)

To the ground product of the provisionally baked ferrite, water and a binder, and optionally a pore controlling agent, are added. The pore controlling agent may include a blowing agent and fine resin particles. The blowing agent may include, e.g., sodium hydrogencarbonate, lithium hydrogencarbonate, ammonium hydrogencarbonate, sodium carbonate, potassium carbonate, lithium carbonate and ammonium carbonate. The fine resin particles may include, e.g., fine particles of polyester; polystyrene; styrene copolymers such as a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, modified phenolic resins, maleic resins, acrylic resins, methacrylic resins, polyvinyl acetate resins, and silicone resins; polyester resins having as a structural unit a monomer selected from aliphatic polyhydric alcohols, aliphatic dicarboxylic acids, aromatic dicarboxylic acids, aromatic dialcohols and diphenols; polyurethane resins, polyamide resins, polyvinyl butyral resins, terpene resins, coumarone indene resins and petroleum resins; and hybrid resins having a polyester unit and a vinyl polymer unit. As the binder, polyvinyl alcohol may be used, for example.

In the step 3, when ground by the wet process, it is preferable to add the binder and optionally the pore controlling agent, taking account of the water also contained in ferrite slurry. The ferrite slurry obtained is dried and granulated by using an atomizing drying machine and in a heating atmosphere of a temperature of from 100° C. or more to 200° C. or less. As the atomizing drying machine, there are no particular limitations thereon as long as the desired particle diameter of porous magnetic core particles can be attained. A spray dryer may be used, for example.

Step 5 (Main Baking Step)

The granulated product is baked at a temperature of from 800° C. or more to 1,200° C. or less for from 1 hour or more to 24 hours or less. Making the baking temperature higher and the baking time longer makes the baking of the porous magnetic core particles proceed, so that the pore diameter becomes smaller and also the number of pores decreases. Thus, the size and number of pores of the porous magnetic core particles can be controlled.

Step 6 (Screening Step)

The particles thus baked are disintegrated, and thereafter may optionally be classified, or sifted with a sieve, to remove coarse particles or fine particles. The porous magnetic core particles may have a volume-base 50% particle diameter (D50) of from 18.0 μm or more to 68.0 μm or less. This is preferable from the viewpoint of prevention of carrier sticking to images and coarse images.

The porous magnetic core particles may have a low physical strength, depending on the size and number of pores in the interiors. Accordingly, also in order to make the magnetic carrier particles improved in physical strength as such, it is preferable to incorporate a resin in at least part of the pores of the porous magnetic core particles.

A method of incorporate the resin in the porous magnetic core particles includes two methods, a method in which the porous magnetic core particles are filled with the resin up to their innermost pores and a method in which the porous magnetic core particles are filled with the resin only at their pores present at particle surfaces. There are no particular limitations on specific methods for filling. Preferred is a method in which the porous magnetic core particles are filled in their pores with a resin solution prepared by mixing a resin and a solvent, followed by removal of the solvent. In the case of a resin soluble in an organic solvent, the organic solvent may include toluene, xylene, cellosolve butyl acetate, methyl ethyl ketone, methyl isobutyl ketone, and methanol. Also, in the case of a water-soluble resin or an emulsion type resin, water may be used as the solvent.

The resin in such a resin solution may preferably be in a content of from 6% by mass or more to 25% by mass or less, based on the solvent. If a resin solution with a resin content of more than 25% by mass is used, it may be difficult to fill the porous magnetic core particles in their pores with the resin solution because of its high viscosity. On the other hand, in a resin content of less than 6% by mass, it is so small as to make the resin low adherent to the porous magnetic core particles, resulting in a non-uniform fill.

There are no particular limitations on the resin with which the porous magnetic core particles are to be filled in their pores, and either of a thermoplastic resin and a thermosetting resin may be used, provided that it may preferably be one having a high affinity for the porous magnetic core particles. The use of a resin having a high affinity makes it easy to simultaneously cover the surfaces of porous magnetic core particles with the resin when the porous magnetic core particles are filled in their pores with the resin.

The resin for filling may include, as the thermoplastic resin, the following: Polystyrene, polymethyl methacrylate, a styrene-acrylate copolymer, a styrene-butadiene copolymer, an ethylene-vinyl acetate copolymer, polyvinyl chloride, polyvinyl acetate, polyvinylidene fluoride resins, fluorocarbon resins, perfluorocarbon resins, perfluorocarbon resins, polyvinyl pyrrolidone, petroleum resins, novolak resins, saturated alkyl polyester resins, polyethylene terephthalate, polybutylene terephthalate, polyarylate, polyamide resins, polyacetal resins, polycarbonate resins, polyether sulfone resins, polysulfone resins, polyphenylene sulfide resins, and polyether ketone resins.

As the thermosetting resin, it may include the following: Phenolic resins, modified phenolic resins, maleic resins, alkyd resins, epoxy resins, unsaturated polyesters obtained by polycondensation of maleic anhydride and terephthalic acid with a polyhydric alcohol, urea resins, melamine resins, urea-melamine resins, xylene resins, toluene resins, guanamine resins, melamine-guanamine resins, acetoguanamine resins, Glyptal resin, furan resins, silicone resins, polyimide resins, polyamide-imide resins, polyether-imide resins and polyurethane resins.

Resins obtained by modifying these resins may also be used. In particular, fluorine-containing resins such as polyvinylidene fluoride resins, fluorocarbon resins, perfluorocarbon resins or solvent-soluble perfluorocarbon resins, and modified silicone resins or silicone resins are preferred as having a high affinity for the porous magnetic core particles.

Of these resins, the thermosetting resin is preferred because it can make the magnetic carrier have a higher strength. In particular, silicone resin is preferred because it can lessen adhesive force between the magnetic carrier particles and the toner and brings an improvement in developing performance For example, as commercially available products, it may include the following: As silicone resins, KR271, KR255 and KR152, available from Shin-Etsu Chemical Co., Ltd; and SR2400, SR2405, SR2410 and SR2411, available from Dow Corning Toray Silicone Co., Ltd. As modified silicone resins, KR206 (alkyd modified), KR5208 (acryl modified), ES1001N (epoxy modified) and KR305 (urethane modified), available from Shin-Etsu Chemical Co., Ltd; and SR2115 (epoxy modified) and SR2110 (alkyd modified), available from Dow Corning Toray Silicone Co., Ltd.

To control the resin thickness at the surfaces of the magnetic carrier particles, it may be done by controlling resin concentration in the resin solution for filling, temperature inside a filling apparatus at the time of filling, temperature at the time of removing the solvent, the number of times of the resin filling step, and so forth.

The resin thickness on the surface of the magnetic carrier particle can make thinner by filling the magnetic carrier particle with a diluted resin solution whose concentration is low, and it can make thicker by filling a resin solution whose concentration is high. Magnetic carrier particles having desired resin thickness on the surface thereof can be obtained by choosing solutions whose concentrations are different from each other, and filling those solutions in multiple times.

Furthermore, the resin thickness on the surface of the magnetic carrier particle can make thinner by slowly stirring a resin solution for filling which temperature is low and evaporating a solvent of the resin solution. On the other hand, the resin thickness on the surface of the magnetic carrier particle can make thicker by stirring a resin solution for filling which temperature is high and evaporating a solvent of the resin solution, while a domain on the magnetic carrier particle which has thin resin thickness can be left appropriately. In the step of filling with the resin, filling at different temperatures may be carried out. This makes magnetic carrier particles obtainable which have favorable resin thickness at their surfaces.

As described above, the resin filling step may be repeated in multiple stages so that the part where the resin is small in thickness and the part where the resin is large in thickness can be controlled at the surfaces of the magnetic carrier particles. Here, resin solutions having the like concentration may be used or resin solutions having different concentrations may be used.

In the magnetic carrier of the present invention, the magnetic carrier particles may be coated on their surfaces with a resin. As a method by which the magnetic carrier particles are coated on their surfaces with a resin, there are no particular limitations thereon, and it may include a method of coating the same by dipping, spraying, brush coating, dry coating or fluidized-bed coating. In particular, the dipping is preferred, which can appropriately make the porous magnetic core particles bare to the surfaces, at the surfaces of the magnetic carrier particles.

Such a resin for coating may be in an amount of from 0.1 part by mass or more to 5.0 parts by mass or less, based on 100 parts by mass of the magnetic carrier particles. This is preferable because the porous magnetic core particles can appropriately be made bare to the surfaces, at the surfaces of the magnetic carrier particles. The resin for coating may be used alone, or may be used in the form of a mixture of various ones. The resin for coating may be the same as, or different from, the resin for filling, and may be either of a thermoplastic resin and a thermosetting resin. The thermoplastic resin may also be mixed with a curing agent or the like so as to be cured when used. In particular, it is preferable to use a resin having higher release properties. The thermoplastic resin and the thermosetting resin may include those described previously. Resins obtained by modifying these resins may also be used.

Of the resins described above, silicone resin is particularly preferred. As the silicone resin, any conventionally known silicone resin may be used.

For example, as commercially available products, it may include the following: As silicone resins, KR271, KR255 and KR152, available from Shin-Etsu Chemical Co., Ltd; and SR2400, SR2405, SR2410 and SR2411, available from Dow Corning Toray Silicone Co., Ltd. As modified silicone resins, KR206 (alkyd modified), KR5208 (acryl modified), ES1001N (epoxy modified) and KR305 (urethane modified), available from Shin-Etsu Chemical Co., Ltd; and SR2115 (epoxy modified) and SR2110 (alkyd modified), available from Dow Corning Toray Silicone Co., Ltd.

The resin described above may be used alone, or may be used in the form of a mixture of any of them. The thermoplastic resin may also be mixed with a curing agent or the like so as to be cured when used. In particular, it is favorable to use a resin having higher release properties.

The coating resin may further be mixed with particles having conductivity or particles, or a material, having charge controllability, when used. The particles having conductivity may include carbon black, magnetite, graphite, zinc oxide and tin oxide. Such particles may be added in an amount of from 0.1 part by mass or more to 10.0 parts by mass or less, based on 100 parts by mass of the coating resin. This is preferable in order to control the resistance of the magnetic carrier.

The particles having charge controllability may include particles of organometallic complexes, particles of organometallic salts, particles of chelate compounds, particles of monoazo metallic complexes, particles of acetylacetone metallic complexes, particles of hydroxycarboxylic acid metallic complexes, particles of polycarboxylic acid metallic complexes, particles of polyol metallic complexes, particles of polymethyl methacrylate resin, particles of melamine resins, particles of phenolic resins, particles of nylon resins, particles of titanium oxide and particles of aluminum oxide. The particles having charge controllability may be added in an amount of from 0.5 part by mass or more to 50.0 parts by mass or less, based on 100 parts by mass of the coating resin. This is preferable in order to control triboelectric charge quantity. The material having charge controllability may be added in an amount of from 2.0 parts by mass or more to 50.0 parts by mass or less, based on 100 parts by mass of the coating resin. This is preferable in order to control triboelectric charge quantity.

As a method of controlling resin thickness on the surfaces of the magnetic carrier particles, it may be done by controlling resin concentration in the resin solution for coating, temperature inside a coating apparatus, temperature and vacuum degree at the time of removing the solvent, the number of times of the resin coating step, and so forth.

The resin thickness on the surface of the magnetic carrier particle can make thinner by coating the magnetic carrier particle with a diluted resin solution whose concentration is low, and it can make thicker by coating a resin solution whose concentration is high.

Furthermore, the resin thickness on the surface of the magnetic carrier particle can make thinner by slowly stirring a resin solution for coating which temperature is low and evaporating a solvent of the resin solution. On the other hand, the resin thickness on the surface of the magnetic carrier particle can make thicker by stirring a resin solution for coating which temperature is high and evaporating a solvent of the resin solution, while a domain on the magnetic carrier particle which has thin resin thickness can be left appropriately.

Furthermore, the resin coating step may be repeated in multiple stages so that the part where the resin is small in thickness and the part where the resin is large in thickness can be controlled on the surfaces of the magnetic carrier particles. Here, resin solutions having the like concentration may be used or resin solutions having different concentrations may be used.

In order to produce the magnetic carrier in which the values of the above A, B and C satisfy the ranges specified in the present invention, it is particularly preferable that the porous magnetic core particles are filled in their pores with the filling resin and thereafter the magnetic carrier particles are further coated on their surfaces with the coating resin. Furthermore coating the magnetic carrier particles on their surfaces with the resin enables more precise control of the resin thickness on the magnetic carrier particle surfaces. Coating the magnetic carrier particles on their surfaces with the coating resin is also preferable from the points of releasability of toner from the magnetic carrier particle surfaces, staining of toner or external additives against the magnetic carrier particle surfaces, charge-providing ability to toner, and control of resistance of the magnetic carrier.

Furthermore, as a method of coating the magnetic carrier particles on their surfaces, a method is particularly preferred in which, onto the porous magnetic core particles having been filled with the filling resin, the coating resin solution is applied dividedly a plurality of times at a temperature of approximately from 60° C. to 100° C. Coating the magnetic carrier particles on their surfaces by such a method enables control of the part where the resin is small in thickness and the part where the resin is large in thickness, on the surfaces of the magnetic carrier particles, thus the magnetic carrier can be obtained in which the values of A, B and C satisfy the ranges specified in the present invention.

The toner to be used together with the magnetic carrier of the present invention may preferably have an average circularity of from 0.940 or more to 1.000 or less. It may further preferably have a circularity of 0.910 or more at cumulative 10% by number from lower circularities in circularity distribution of particles with a circle-equivalent diameter of from 1.985 μm or more to less than 39.69 μm of the toner as measured with a flow type particle image analyzer.

The use of the toner having average circularity within the above range and the magnetic carrier of the present invention in combination enables control of transport performance of the two-component developer on the developer carrying member, and hence enable achievement of superior developing performance over a long period of time.

Furthermore, the toner may preferably have a weight-average particle diameter (D4) of from 3.0 μm or more to 8.0 μm or less. The use of the toner having weight-average particle diameter (D4) within the above range and the magnetic carrier of the present invention in combination can make the carrier and the toner have good releasability between them and can keep any faulty transport from occurring because of slip of the developer on the developer carrying member.

The toner has a binder resin, which, in order to achieve both storage stability and low-temperature fixing performance of the toner, may preferably have a peak molecular weight (Mp) of from 2,000 or more to 50,000 or less, a number average molecular weight (Mn) of from 1,500 or more to 30,000 or less and a weight average molecular weight (Mw) of from 2,000 or more to 1,000,000 or less in its molecular weight distribution measured by gel permeation chromatography (GPC), and a glass transition temperature (Tg) of from 40° C. or more to 80° C. or less.

In the toner, a wax may be contained. The wax may preferably be used in an amount of from 0.5 part by mass or more to 20 parts by mass or less, and much preferably from 2 parts by mass or more to 15 parts by mass or less, based on 100 parts by mass of the binder resin. The wax may also preferably be from 45° C. or more to 140° C. or less in peak temperature of its maximum endothermic peak. As long as the peak temperature is within this range, this is preferable because the toner can achieve both storage stability and hot-offset properties. The wax may include, e.g., the following: Hydrocarbon waxes such as paraffin wax and Fischer-Tropsch wax; waxes composed chiefly of a fatty ester, such as carnauba wax, behenyl behenate wax and montanate wax; and those obtained by subjecting part or the whole of fatty esters to deoxidizing treatment, such as dioxidized carnauba wax.

The toner has a colorant, which may preferably be used in an amount of from 0.1 part by mass or more to 30 parts by mass or less, much preferably from 0.5 to 20 parts by mass, and most preferably from 3 to 18 parts by mass, based on 100 parts by mass of the binder resin. In particular, in a black toner, it may be in an amount of from 4 to 15 parts by mass; in a magenta toner, from 4 to 18 parts by mass; in a cyan toner, from 3 to 12 parts by mass; and in a yellow toner, from 4 to 17 parts by mass. The colorant may preferably be used within the above ranges from the viewpoint of its dispersibility and color development.

The toner may optionally be incorporated with a charge control agent. As the charge control agent to be incorporated in the toner, known one may be used. In particular, an aromatic carboxylic acid metal compound is particularly preferred, which is colorless, makes the toner chargeable at a high speed and can stably maintain a constant charge quantity. The charge control agent may preferably be added in an amount of from 0.2 part by mass or more to 10 parts by mass or less, based on 100 parts by mass of the binder resin.

To the toner, an external additive may preferably be added in order to improve fluidity. As the external additive, preferred is an inorganic fine powder of silica, titanium oxide or aluminum oxide. It is preferable for the inorganic fine powder to have been made hydrophobic using a hydrophobic-treating agent such as a silane compound, a silicone oil or a mixture of these. The external additive may preferably be used in an amount of from 0.1 part by mass or more to 5.0 parts by mass or less, based on 100 parts by mass of toner particles. The mixing the toner particles and the external additive can employ known mixing machines such as Henschel mixer.

As processes for producing the toner particles, available are, e.g., a pulverization process, in which the binder resin and the colorant are melt-kneaded and the kneaded product is cooled, followed by pulverization and then classification; a suspension granulation process, in which a solution prepared by dissolving or dispersing the binder resin and the colorant in a solvent is introduced into an aqueous medium to carry out suspension granulation, followed by removal of the solvent; a suspension polymerization process, in which a monomer composition prepared by uniformly dissolving or dispersing the colorant in a monomer is dispersed in a continuous layer (e.g., an aqueous phase) containing a dispersion stabilizer and then polymerization reaction is carried out to produce toner particles; a dispersion polymerization process, in which toner particles are directly produced by using an aqueous organic solvent in which monomers as such are soluble but become insoluble upon formation of polymers or toner particles are directly produced by using an aqueous organic solvent in which monomers are soluble and polymers obtained are insoluble; an emulsion polymerization process, in which toner particles are produced by direct polymerization in the presence of a water-soluble polar polymerization initiator; and an emulsion granulation process, in which toner particles are obtained through at least the step of agglomerating fine polymer particles and fine colorant particles to form a fine-particle agglomerate and the step of ripening to cause fusion between fine particles in the fine-particle agglomerate.

A procedure for producing the toner by pulverization is described. In the step of mixing raw materials, as materials making up toner particles, the binder resin, the colorant, the wax and any desired materials, for example, are weighed in stated quantities and are compounded and mixed. As examples of a mixer therefor, it includes Doublecon Mixer, a V-type mixer, a drum type mixer, Super mixer, Henschel mixer, Nauta mixer and MECHANO HYBRID.

Next, the materials thus mixed are melt-kneaded to disperse the colorant and so forth in the binder resin. In this melt kneading step, a batch-wise kneader such as a pressure kneader or Banbury mixer, or a continuous type kneader may be used. Single-screw or twin-screw extruders are prevailing because of an advantage of enabling continuous production. For example, usable are a KTK type twin-screw extruder manufactured by Kobe Steel, Ltd., a TEM type twin-screw extruder manufactured by Toshiba Machine Co., Ltd., PCM Kneader manufactured by Ikegai Corp., a twin-screw extruder manufactured by KCK Co., a co-kneader manufactured by Coperion Buss Ag., and KNEADEX, manufactured by Mitsui Mining & Smelting Co., Ltd.

Furthermore, a colored resin composition obtained by the melt kneading may be rolled out by means of a twin-roll mill or the like, followed by cooling through a cooling step by using water or the like.

Then, the cooled product of the resin composition is pulverized in the pulverization step into a product having the desired particle diameter. In the pulverization step, the cooled colored resin composition is coarsely ground by means of a grinding machine such as a crusher, a hammer mill or a feather mill, and is thereafter further finely pulverized by means of, e.g., Criptron system, manufactured by Kawasaki Heavy Industries, Ltd.; Super Rotor, manufactured by Nisshin Engineering Inc.; Turbo Mill, manufactured by Turbo Kogyo Co., Ltd.; or a fine grinding machine of an air jet system.

Thereafter, the pulverized product obtained may optionally be classified by using a classifier such as ELBOW JET, manufactured by Nittetsu Mining Co., Ltd., which is of an inertial classification system; TURBOPLEX, manufactured by Hosokawa Micron Corporation, which is of a centrifugal classification system; TSP Separator, manufactured by Hosokawa Micron Corporation; or FACULTY, manufactured by Hosokawa Micron Corporation; or a sifting machine. Thus, the toner particles are obtained.

Furthermore, after the pulverization, the product may also optionally be subjected to surface modification treatment such as treatment for making spherical, by using Hybridization system, manufactured by Nara Machinery Co., Ltd.; Mechanofusion system, manufactured by Hosokawa Micron Corporation; or FACULTY, manufactured by Hosokawa Micron Corporation.

Figure 1:
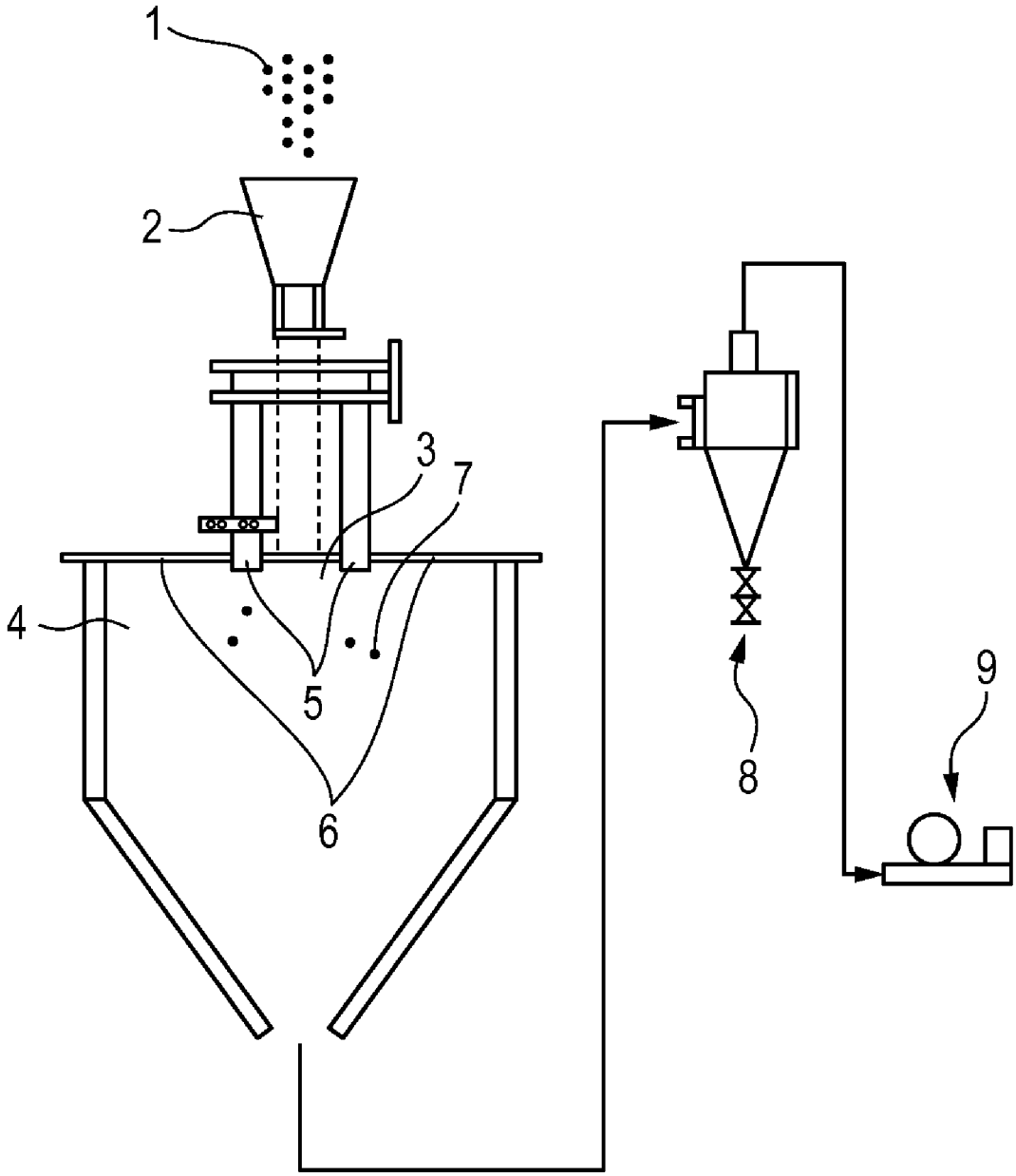
FIG. 1 is a diagrammatic view of a surface modifying apparatus usable in the present invention.

For the surface modification of the toner particles, a surface-modifying apparatus may also be used which is, e.g., as shown in FIG. 1. Using an auto-feeder 2, toner particles 1 are fed to the interior 4 of the surface-modifying apparatus through a feed nozzle 3. Air in the interior 4 of the surface-modifying apparatus is kept sucked by means of a blower 9, and hence the toner particles 1 fed thereinto through the feed nozzle 3 are dispersed in the machine. The toner particles 7 having been dispersed in the machine are instantaneously heated by hot air flowed thereinto from a hot-air flow-in opening to become surface-modified. Toner particles 7 being surface-modified are instantaneously cooled by cold air flowed in from a cold-air flow-in opening 6. The toner particles 1 having been surface-modified are sucked by means of the blower 9, and then collected by means of a cyclone 8.

The magnetic carrier of the present invention is used in a two-component developer containing the toner and the magnetic carrier. When used in the two-component developer, the toner and the magnetic carrier may preferably be in such a blend proportion that the former is in a content of from 2 parts by mass or more to 15 parts by mass or less, and much preferably from 4 parts by mass or more to 12 parts by mass or less, based on 100 parts by mass of the latter. Setting the blend proportion within the above range enables achievement of a high image density and enables the toner to less scatter.

The two-component developer of the present invention may also be used as a replenishing developer used in a two-component developing system in which the replenishing developer is fed to a developing assembly and the magnetic carrier that has become excess in the interior of the developing assembly is discharged out of the developing assembly. When used as the replenishing developer, from the viewpoint of improvement in running performance of the developer, the toner and the magnetic carrier may preferably be in such a blend proportion that the former is in a content of from 2 parts by mass or more to 50 parts by mass or less, based on 1 part by mass of the latter.

How to Measure Volume-Base 50% Particle Diameter (D50) of Magnetic Carrier and Porous Magnetic Cores Particle size distribution is measured with a laser diffraction-scattering particle size distribution measuring instrument "MICROTRACK MT3300EX" (manufactured by Nikkiso Co. Ltd.). In the measurement, "One-shot Drying Sample Conditioner TURBOTRAC" (manufactured by Nikkiso Co. Ltd.) is attached, which is a sample feeder for dry-process measurement. As feed conditions of TURBOTRAC, a dust collector is used as a vacuum source, setting air flow at about 33 liters/second and pressure at about 17 kPa. Control is automatically made on software. As particle diameter, 50% particle diameter (D50) is found, which is the volume-base cumulative value. Control and analysis are made using attached software (Version 10.3.3-202D). Measurement conditions are so set that Set Zero time is 10 seconds, measurement time is 10 seconds, number of time for measurement is one time, particle diffraction index is 1.81, particle shape is non-sphere, measurement upper limit is 1,408 μm and measurement lower limit is 0.243 μm. The measurement is made in a normal-temperature and normal-humidity environment (temperature about 23° C./humidity about 60% RH).

How to Measure Resin Thickness Found by Measuring Distance from Surface of Magnetic Carrier Particle to Surface of Porous Magnetic Core Particle in Cross Section of Magnetic Carrier Particle In cross-sectional processing of the magnetic carrier particles, a focused ion beam (FIB) processing observation instrument FB-2100 (manufactured by Hitachi Ltd.) is used. A sample stand for FIB is coated thereon with a carbon paste, and magnetic carrier particles are made to stick thereon in such a way that the particles are one by one independently present, where platinum is vacuum-deposited as a conductive film to prepare a sample. The sample is set on the FIB instrument, and is roughly processed at an accelerating voltage of 40 kV and using a Ga ionic source, subsequently followed by finish processing (beam current: 7 nA) to cut out sample cross sections.

Here, the magnetic carrier particles used as the sample are magnetic carrier particles having $D50\times0.9 \leqq Dmax \leqq D50\times1.1$ as maximum diameter Dmax of each sample, which are taken as an object of measurement. The Dmax is defined to be the maximum diameter found when the carrier particles are observed in the parallel direction as viewed from the sample-stuck surface. Furthermore, the position of a plane in the direction parallel to each sample-stuck surface is taken as distance h from the sample-stuck surface (the h comes around radius-equivalent diameter when approximated to a sphere). The cross sections are cut out within the range of from 0.9×h or more to 1.1×h or less, in the direction perpendicular to the sample-stuck surface.

The samples thus cross-section processed may be used as it is, for the observation on a scanning electron microscope (SEM). The emission level of reflected electrons depends on the atomic numbers of materials constituting the sample, from the fact of which compositional images of cross sections of the magnetic carrier particles can be obtained. In the observation of cross sections of the magnetic carrier particles of the present invention, it is made using a scanning electron microscope (SEM) 594800, manufactured by Hitachi Ltd., at an accelerating voltage of 2.0 kV.

The resin thickness found by measuring the distance from the surface of the magnetic carrier particle to the surface of the porous magnetic core particle in the cross section of the magnetic carrier particle is calculated according to the following procedure, about a gray-scale SEM reflected electron image of cross sections of the magnetic carrier particles by using image analytical software IMAGE-PRO PLUS, available from Media Cybernetics, Inc.

Figure 2:
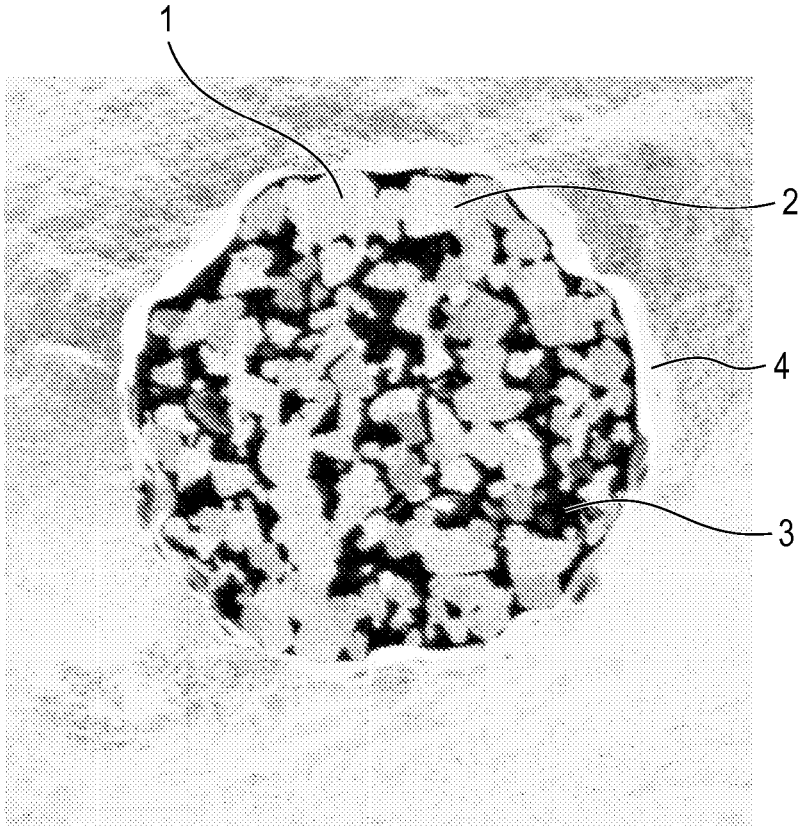
FIG. 2 shows an example of an SEM reflected electron image of a cross section of a magnetic carrier particle in the present invention.

A processed cross section region of the magnetic carrier particles is beforehand designated on the image. An example of an SEM reflected electron image in which only a region at a processed cross section 1 of the magnetic carrier particles of the present invention has been designated is shown in FIG. 2. In FIG. 2, a porous magnetic core particle portion 2, a resin portion 3, and a magnetic carrier particle surface 4 are presented.

Figure 3:
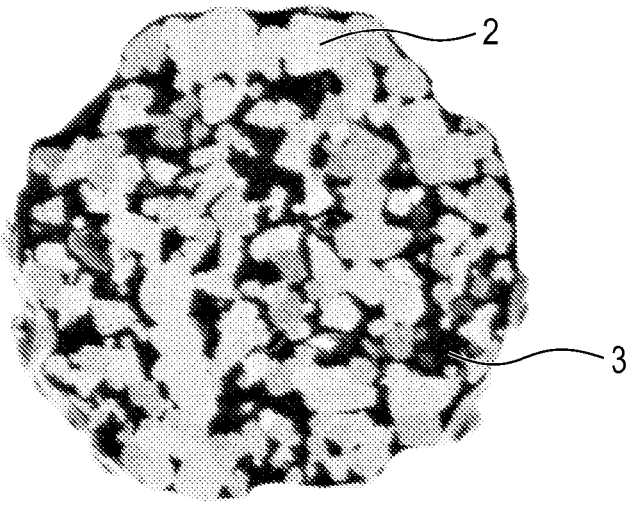
FIG. 3 shows an example of a divided SEM reflected electron image of a cross section of a magnetic carrier particle in the present invention.

Only the processed cross section region 1 of the magnetic carrier particles is beforehand designated on the image. About the processed cross section region 1 thus designated, it is made into a gray-scale image with 256 gradations. This image is divided thereon into two regions, a region of resin portions for 0 to 129 gradations from the lower place of gradation values and a region of porous magnetic core particle portions for 130 to 255 gradations. The 255th gradation is taken as a background portion outside the processed cross section region. As the result, FIG. 3 is presented as a view in which the SEM reflected electron image has been binary-coded, where these regions are shown as a porous magnetic core particle portion 2 and a resin portion 3.

Figure 6:
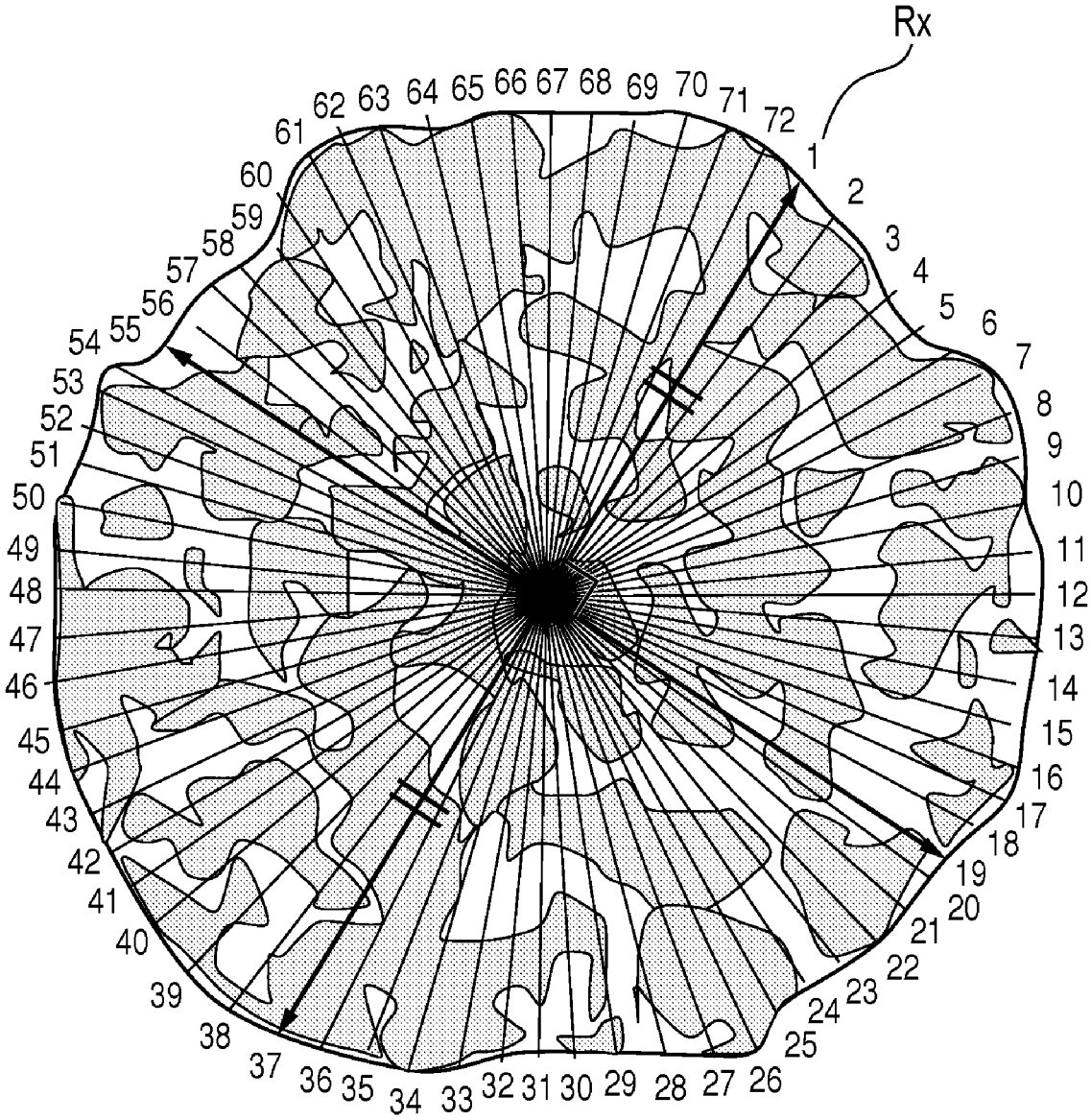
FIG. 6 is a view diagrammatically showing an example in which straight lines are drawn which are for measuring the distance from the surface of a magnetic carrier particle to the surface of a porous magnetic core particle in the present invention.

FIGS. 4 and 6 are views diagrammatically showing an example of the measurement of the resin thickness found by measuring the distance from the surface of the magnetic carrier particle to the surface of the porous magnetic core particle in a cross section of the magnetic carrier particles of the present invention. As procedure for its operation, it is as follows:

1. Rx is defined as the maximum diameter of the processed cross section region of the magnetic carrier particle.
2. The middle point of the Rx is taken as a reference point of the cross section of the magnetic carrier particle. And, Ry is defined as the diameter orthogonally intersected with the Rx at the middle point.
3. Measurement is made on magnetic carrier particles which satisfies Rx/Ry≦1.2. The magnetic carrier in the present invention preferably contains 90% by number or more of the magnetic carrier particles satisfying Rx/Ry≦1.2. Straight lines that divide the cross section into 72 at intervals of 5° are drawn from the middle point of Rx that is the reference point of the magnetic carrier particle toward the surface of the magnetic carrier particle. Then, one of the straight lines on the Rx is denoted as 1, and the straight lines are clockwise numbered from 1 to 72. The results of numbering are shown in FIG. 6. On these straight lines each, the distance from the surface of the magnetic carrier particle to the surface of the porous magnetic core particle is measured to take it as the resin thickness. This operation is repeatedly made 72 times.
4. The number A of lines among the whole lines (72 lines) and along which the resin is in a thickness of from 0.0 μm or more to 0.3 μm or less, the number B of lines among the whole lines (72 lines) and at portions where the resin is in a thickness of from 1.5 μm or more to 5.0 μm or less, and the average value and standard deviation of the resin thickness with respect to the whole lines (72 lines) are calculated.
5. An average value of the distance along straight lines of from the 1st line to the 18th line among the straight lines that divide the cross section equally into 72 is set as an average value 1, an average value of the distance along straight lines of from the 19th line to the 36th line is set as an average value 2, an average value of the distance along straight lines of from the 37th line to the 54th line is set as an average value 3 and an average value of the distance along straight lines of from the 55th line to the 72nd line is set as an average value 4, where the respective average values of the distance from the surface of the magnetic carrier particle to the surface of the porous magnetic core particle are calculated. A difference between the maximum value and the minimum value in these average values 1 to 4 is calculated.
6. Taking as an object the magnetic carrier particles coming to Rx/Ry≦1.2, the measurement is repeated about 25 magnetic carrier particles, and its average value is calculated. The proportion of the magnetic carrier particles satisfying Rx/Ry≦1.2 is calculated by dividing by the number of cross-section processed particles required until the measurement has reached 25 particles.

(Expression)

$$\text{Proportion of particles coming to } Rx/Ry \leqq 1.2 = 25/\text{number of cross-section processed particles} \times 100.$$

Measurement of Average Circularity of Toner and Circularity at Cumulative 10% by Number of Toner The average circularity of the toner is measured with a flow type particle image analyzer "FPIA-3000" (manufactured by Sysmex Corporation) on the basis of conditions of measurement and analysis made in operating corrections.

Projected area S and peripheral length L of particle image are used to determine circle-equivalent diameter and circularity. The circle-equivalent diameter refers to the diameter of a circle having the same area as the projected area of the particle image. Circularity C is defined as a value found when the peripheral length of a circle that is found from the circle-equivalent diameter is divided by the peripheral length of particle projected area, and is calculated according to the following expression.

$$\text{Circularity } C = [2 \times (\pi \times S)^{1/2}]/L.$$

The circularity is 1 when the particle image is circular. The larger the degree of unevenness of the periphery of the particle image is, the smaller value the circularity has. The circularity of each particle is calculated, and thereafter the arithmetic mean of the circularities thus found is calculated and its value is taken as average circularity.

A specific way of measurement is as follows: First, about 20 ml of ion-exchanged water, from which impurity solid matter and the like have beforehand been removed, is put into a container made of glass. To this water, about 0.2 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Furthermore, about 0.02 g of a measuring sample is added, followed by dispersion treatment for 2 minutes by means of an ultrasonic dispersion machine to prepare a liquid dispersion for measurement. In that course, the dispersion system is appropriately so cooled that the liquid dispersion may have a temperature of 10° C. or more to 40° C. or less. As the ultrasonic dispersion machine, a desk-top ultrasonic dispersion machine of 50 kHz in oscillation frequency and 150

W in electric output (e.g., "VS-150", manufactured by Velvo-Clear Co.) is used. Into its water tank, a stated amount of ion-exchanged water is put, and about 2 ml of the above CONTAMINON N is fed into this water tank.

In the measurement, the flow type particle image analyzer is used, having a standard objective lens (10 magnifications), and Particle Sheath "PSE-900A" (available from Sysmex Corporation) is used as a sheath solution. The liquid dispersion having been controlled according to the above procedure is introduced into the flow type particle analyzer, where 3,000 toner particles are counted in an HPE measuring mode and in a total count mode. Then, the binary-coded threshold value at the time of particle analysis is set to 85%, and the diameters of particles to be analyzed are limited to circle-equivalent diameter of from 1.985 μm or more to less than 39.69 μm, where the average circularity of toner particles is determined.

In measuring the circularity, before the measurement is started, autofocus control is performed using standard latex particles (e.g., "RESEARCH AND TEST PARTICLES Latex Microsphere Suspensions 5200A", available from Duke Scientific Corporation). Thereafter, the autofocus control may preferably be performed at intervals of 2 hours after the measurement has been started.

In Examples of the present invention, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameters of particles to be analyzed were limited to the circle-equivalent diameter of from 1.985 μm or more to less than 39.69 μm.

Furthermore, on a screen of analysis results, the diameters of particles to be analyzed are limited to the circle-equivalent diameter of from 1.985 μm or more to less than 39.69 μm, and a numeral 10 is inputted to the value of shape-restricting "lower (%)". On the screen of analysis results, the lower value of circularity is calculated as circularity at cumulative 10% by number as found from lower circularities.

Measurement of Weight Average Particle Diameter (D4) of Toner

The weight average particle diameter (D4) of the toner is measured in the following way. A precision particle size distribution measuring instrument "Coulter Counter Multisizer 3" (registered trademark; manufactured by Beckman Coulter, Inc.) is used as a measuring instrument, which has an aperture tube of 100 μm in size and employing the aperture impedance method. To set the conditions for measurement and analyze the data of measurement, software "Beckman Coulter Multisizer 3 Version 3.51" (produced by Beckman Coulter, Inc.) is used, which is attached to Multisizer 3 for its exclusive use. The measurement is made through 25,000 channels as effective measuring channels in number.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Before the measurement and analysis are made, the software for exclusive use is set in the following way. On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked. On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

(1) About 200 ml of the aqueous electrolytic solution is put into a 250 ml round-bottomed beaker made of glass for exclusive use in Multisizer 3, and this is set on a sample stand, where stirring with a stirrer rod is carried out at revolutions/second in the anticlockwise direction. Then, a "Flash of Aperture" function of the software for exclusive use is operated to beforehand remove any dirt and air bubbles in the aperture tube.

(2) About 30 ml of the aqueous electrolytic solution is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass.

(3) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into a water tank of the ultrasonic dispersion machine, about 3.3 liters of ion-exchanged water is put, and about 2 ml of CONTAMINON N is added to this water tank.

(4) The beaker of the above (2) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

(5) In the state the aqueous electrolytic solution in the beaker of the above (4) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(6) To the round-bottomed beaker of the above (1), placed inside the sample stand, the aqueous electrolytic solution in which the toner has been dispersed in the above (5) is dropwise added by using a pipette, and the measuring concentration is so adjusted as to be about 5%. Then the measurement is made until the measuring particles come to 50,000 particles in number.

(7) The data of measurement are analyzed by using the above software attached to the measuring instrument for its exclusive use, to calculate the weight average particle diameter (D4). Here, "Average Diameter" on an "Analysis/Volume Statistic Value (Arithmetic Mean)" screen when set to graph/% by volume in the software for exclusive use is the weight average particle diameter (D4).

How to Measure Peak Temperature of Maximum Endothermic Peak of Wax and Glass Transition Temperature Tg of Binder Resin or Toner The peak temperature of a maximum endothermic peak of the wax is measured according to ASTM D3418-82, using a differential scanning calorimetry analyzer "Q1000" (manufactured by TA Instruments Japan Ltd.).

The temperature at the detecting portion of the instrument is corrected on the basis of melting points of indium and zinc, and the amount of heat is corrected on the basis of heat of fusion of indium.

Stated specifically, the wax is precisely weighed in an amount of about 10 mg, and this is put into a pan made of aluminum and an empty pan made of aluminum is used as reference. Measurement is made at a heating rate of 10° C./min within the measurement temperature range of from 30° C. to 200° C. Here, in the measurement, the wax is first heated to 200° C., then cooled to 30° C. and thereafter heated again. In the course of this second-time heating, a maximum endothermic peak of a DSC curve in the temperature range of from 30° C. to 200° C. is regarded as the maximum endothermic peak of the wax in the present invention.

As to the glass transition temperature (Tg) of the binder resin or toner, the binder resin or toner is precisely weighed in an amount of about 10 mg, and measurement is made in the same way as that for the measurement of the peak temperature of the maximum endothermic peak of the wax. In that case, changes in specific heat are found within the range of temperature of from 40° C. or more to 100° C. or less. The point at which the middle-point line between the base lines of a differential thermal curve before and after the appearance of the changes in specific heat thus found and the differential thermal curve intersect is regarded as the glass transition temperature Tg of the binder resin or toner.

How to Measure Peak Molecular Weight (Mp), Number Average Molecular Weight (Mn) and Weight Average Molecular Weight (Mw) of THF-Soluble Matter of Binder Resin or Toner The peak molecular weight (Mp), number average molecular weight (Mn) and weight average molecular weight (Mw) are measured by gel permeation chromatography (GPC) in the following way. First, a sample is dissolved in tetrahydrofuran (THF) at room temperature over a period of 24 hours. The binder resin or toner is used as the sample. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

How to Measure Degree of Hydrophobicity of External Additive

The measurement of the degree of hydrophobicity by the use of methanol to evaluate the degree of hydrophobicity of the external additive is made in the following way. 0.2 g of the external additive is added to 50 ml of water held in an Erlenmeyer flask. The methanol is dropped from a burette to carry out titration. Here, the solution in the flask is always stirred by means of a magnetic stirrer. The completion of sediment of the external additive is confirmed by the fact that it has been suspended in its total mass in the solution, and the degree of hydrophobicity is expressed as volume percentage of methanol in the aqueous mixture of methanol and water at the time the sedimentation has come to an end point.

EXAMPLES

Porous Magnetic Cores

Production Example 1

| | |
|---|---|
| $Fe_2O_3$ | 58.7% by mass |
| $MnCO_3$ | 34.9% by mass |
| $Mg(OH)_2$ | 5.2% by mass |
| $SrCO_3$ | 1.2% by mass |

Ferrite raw materials were so weighed that the above materials were in the above compositional ratio. Thereafter, these were ground and mixed for 2 hours by means of a dry-process ball mill making use of zirconia balls of 10 mm in diameter (step 1: weighing and mixing step). After these were ground and mixed, the mixture obtained was baked at a temperature of 950° C. for 2 hours in the atmosphere to produce provisionally baked ferrite (step 2: provisional baking step). The ferrite was composed as shown below.

$$(MnO)_a(MgO)_b(SrO)_c(Fe_2O_3)_d$$

In the above formula, a=0.395, b=0.116, c=0.011 and d=0.478.

The provisionally baked ferrite was crushed to a size of bout 0.5 mm by means of a crusher, and thereafter, with addition of 30 parts by mass of water based on 100 parts by mass of the provisionally baked ferrite, the crushed product was ground for 4 hours by means of a wet-process ball mill making use of zirconia balls (10 mm in diameter) to obtain ferrite slurry (a finely ground product of provisionally baked ferrite) (step 3: grinding step). To the ferrite slurry, 2.0 parts by mass of polyvinyl alcohol based on 100 parts by mass of the provisionally baked ferrite was added as a binder, and the ferrite slurry was granulated into spherical particles of about 36 μm in diameter by means of a spray dryer (manufactured by Ohkawara Kakohki Co., Ltd.) (step 4: granulation step). The granulated product was baked at a temperature of 1,100° C. for 4 hours in an atmosphere of nitrogen (oxygen concentration: 0.01% by volume or less) by using an electric furnace (step 5: main baking step). Particles standing agglomerate were disintegrated, followed by sifting with a sieve of 250 μm in mesh opening to remove coarse particles to obtain Porous Magnetic Cores 1 (step 6: screening step).

Porous Magnetic Cores

Production Example 2

Porous Magnetic Cores 2 were obtained in the same way as those in Porous Magnetic Cores Production Example 1 except that, in Porous Magnetic Cores Production Example 1, the time of 4 hours for grinding with the wet-process ball mill in the step 3 was changed to 5 hours and the baking temperature of 1,100° C. in the step 5 was changed to 1,050° C.

Porous Magnetic Cores

Production Example 3

Porous Magnetic Cores 3 were obtained in the same way as those in Porous Magnetic Cores Production Example 1 except that, in Porous Magnetic Cores Production Example 1, the size of about 0.5 mm in the crushing with a crusher and the time of 4 hours for grinding with the wet-process ball mill in the step 3 were changed to about 0.3 mm and 2 hours, respectively.

Porous Magnetic Cores

Production Example 4

Porous Magnetic Cores 4 were obtained in the same way as those in Porous Magnetic Cores Production Example 1 except that, in Porous Magnetic Cores Production Example 1, the baking temperature of 1,100° C. in the step 5 was changed to 1,150° C.

Porous Magnetic Cores

Production Example 5

| | |
|---|---|
| $Fe_2O_3$ | 61.4% by mass |
| $MnCO_3$ | 31.0% by mass |
| $Mg(OH)_2$ | 6.8% by mass |
| $SrCO_3$ | 0.8% by mass |

Porous Magnetic Cores 5 were obtained in the same way as those in Porous Magnetic Cores Production Example 1 except the following: In Porous Magnetic Cores Production Example 1, the proportion of the ferrite raw materials in the step 1 was changed as shown above. The size of about 0.5 mm in the crushing with a crusher and the time of 4 hours for grinding with the wet-process ball mill in the step 3 of Porous Magnetic Cores Production Example 1 were changed to about 0.3 mm and 5 hours, respectively. The amount of 2% for the polyvinyl alcohol added in the step 4 of Porous Magnetic Cores Production Example 1 was changed to 1%. The baking temperature of 1,100° C. in the step 5 was changed to 1,250° C.

Porous Magnetic Cores

Production Example 6

Porous Magnetic Cores 6 were obtained in the same way as those in Porous Magnetic Cores Production Example 1 except the following: In Porous Magnetic Cores Production Example 1, 2% of sodium carbonate was added together with 2% of the polyvinyl alcohol in the step 4. Also, the baking time of 4 hours and the baking temperature of 1,100° C. in the step 5 baking step were changed to 2 hours and 1,050° C., respectively.

Porous Magnetic Cores

Production Example 7

| | |
|---|---|
| $Fe_2O_3$ | 62.4% by mass |
| $MnCO_3$ | 30.5% by mass |
| $Mg(OH)_2$ | 6.4% by mass |
| $SrCO_3$ | 0.7% by mass |

Porous Magnetic Cores 7 were obtained in the same way as those in Porous Magnetic Cores Production Example 1 except the following: In Porous Magnetic Cores Production Example 1, the proportion of the ferrite raw materials in the step 1 was changed as shown above. The size of about 0.5 mm in the crushing with a crusher and the time of 4 hours for grinding with the wet-process ball mill in the step 3 of Porous Magnetic Cores Production Example 1 were changed to about 0.3 mm and 1 hour, respectively. After the grinding with the ball mill, the slurry obtained was ground for 4 hours by means of a wet-process bead mill making use of zirconia balls (1 mm in diameter) to obtain ferrite slurry.

Porous Magnetic Cores

Production Example 8

| | |
|---|---|
| $Fe_2O_3$ | 71.0% by mass |
| CuO | 12.5% by mass |
| ZnO | 16.5% by mass |

Ferrite raw materials were so weighed that the above materials were in the above compositional ratio. Thereafter, with addition of water, these were mixed by a wet process by means of a ball mill (step 1: weighing and mixing step). After these were ground and mixed, the mixture obtained was baked at a temperature of 950° C. for 2 hours in the atmosphere to produce ferrite (step 2: provisional baking step). This ferrite was crushed to a size of bout 0.5 mm by means of a crusher, and thereafter, the crushed product was ground for 6 hours by means of a wet-process ball mill making use of stainless-steel balls (10 mm in diameter) to obtain ferrite slurry (step 3: grinding step). To the ferrite slurry, 2% of polyvinyl alcohol was added as a binder, and the ferrite slurry was granulated into spherical particles of about 36 μm in diameter by means of a spray dryer (manufactured by Ohkawara Kakohki Co., Ltd.) (step 4: granulation step). The granulated product was baked at a temperature of 1,300° C. for 4 hours in the atmosphere (step 5: main baking step). Particles standing agglomerate were disintegrated, followed by sifting with a sieve of 250 μm in mesh opening to remove coarse particles to obtain Porous Magnetic Cores 8 (step 6: screening step).

Porous Magnetic Cores

Production Example 9

| | |
|---|---|
| $Fe_2O_3$ | 61.8% by mass |
| $MnCO_3$ | 31.1% by mass |
| $Mg(OH)_2$ | 6.5% by mass |
| $SrCO_3$ | 0.6% by mass |

Ferrite raw materials were so weighed that the above materials were in the above compositional ratio, and water was added thereto. Thereafter, these were ground and mixed for 5 hours by means of a wet-process media mill to obtain slurry. The slurry obtained was dried using a spray dryer to obtain truly spherical particles (step 1: weighing and mixing step). After these were ground and mixed, the mixture obtained was baked at a temperature of 950° C. for 2 hours in the atmosphere to produce provisionally baked ferrite (step 2: provisional baking step). This ferrite was crushed to a size of bout 0.5 mm by means of a crusher. Thereafter, with addition of 30 parts by mass of water based on 100 parts by mass of the provisionally baked ferrite, the crushed product was ground for 1 hour by means of a wet-process ball mill making use of stainless-steel beads of ⅛ inch in diameter, and thereafter further ground for 4 hours by using stainless-steel beads of 1/16 inch in diameter to obtain ferrite slurry (a finely ground product of provisionally baked ferrite) (step 3: grinding step). To the ferrite slurry, 1.0 part by mass of polyvinyl alcohol based on 100 parts by mass of the provisionally baked ferrite was added as a binder, and the ferrite slurry was granulated into spherical particles of about 34 μm in diameter by means of a spray dryer (manufactured by Ohkawara Kakohki Co., Ltd.) (step 4: granulation step). In order to control baking atmosphere, the granulated product was baked at a temperature of 1,100° C. for 4 hours in an atmosphere of nitrogen (oxygen concentration: 0.01% by volume or less) by using an electric furnace (step 5: main baking step). Particles standing agglomerate were disintegrated, followed by sifting with a sieve of 250 μm in mesh opening to remove coarse particles to obtain Porous Magnetic Cores 9 (step 6: screening step).

The composition and particle diameter of Porous Magnetic Cores 1 to 9 each are shown in Table 1.

TABLE 1

| Porous Magnetic Cores No. | Composition | Particle diameter (D50) |
|---|---|---|
| 1 | $(MnO)_{0.395}(MgO)_{0.116}(SrO)_{0.011}(Fe_2O_3)_{0.478}$ | 36.0 μm |
| 2 | $(MnO)_{0.395}(MgO)_{0.116}(SrO)_{0.011}(Fe_2O_3)_{0.478}$ | 36.0 μm |
| 3 | $(MnO)_{0.395}(MgO)_{0.116}(SrO)_{0.011}(Fe_2O_3)_{0.478}$ | 36.0 μm |
| 4 | $(MnO)_{0.395}(MgO)_{0.116}(SrO)_{0.011}(Fe_2O_3)_{0.478}$ | 36.0 μm |
| 5 | $(MnO)_{0.348}(MgO)_{0.150}(SrO)_{0.007}(Fe_2O_3)_{0.495}$ | 36.0 μm |
| 6 | $(MnO)_{0.395}(MgO)_{0.116}(SrO)_{0.011}(Fe_2O_3)_{0.478}$ | 36.0 μm |
| 7 | $(MnO)_{0.344}(MgO)_{0.143}(SrO)_{0.006}(Fe_2O_3)_{0.507}$ | 36.0 μm |
| 8 | $(CuO)_{0.13}(ZnO)_{0.17}(Fe_2O_3)_{0.70}$ | 36.0 μm |
| 9 | $(MnO)_{0.350}(MgO)_{0.145}(SrO)_{0.005}(Fe_2O_3)_{0.500}$ | 34.2 μm |

Synthesis of Copolymer Solution 1

100.0 parts by mass of methyl methacrylate monomer was put into a four-necked flask having a reflux condenser, a thermometer, a nitrogen suction pipe and a stirrer of a grinding-in system. Furthermore, 90.0 parts by mass of toluene, 110.0 parts by mass of methyl ethyl ketone and 2.0 parts by mass of azobizisovaleronitrile were added thereto. The mixture obtained was kept at a temperature of 70° C. for 10 hours in a stream of nitrogen. After polymerization reaction was completed, washing was repeated to obtain Copolymer Solution 1 (solid content: 33% by mass).

Synthesis of Copolymer Solution 2

25.0 parts by mass of methyl methacrylate macromer with a weight average molecular weight of 5,000 and 75.0 parts by mass of cyclohexyl methacrylate monomer were put into a four-necked flask having a reflux condenser, a thermometer, a nitrogen suction pipe and a stirrer of a grinding-in system. Furthermore, 90.0 parts by mass of toluene, 110.0 parts by mass of methyl ethyl ketone and 2.0 parts by mass of azobizisovaleronitrile were added thereto. The mixture obtained was kept at a temperature of 70° C. for 10 hours in a stream of nitrogen. After polymerization reaction was completed, washing was repeated to obtain Copolymer Solution 2 (solid content: 33% by mass).

Preparation of Resin Solution 1

Straight silicone resin (KR271, available from Shin-Etsu Chemical Co., Ltd.) was so diluted with toluene as to be in a solid-matter concentration of 20.0% by mass and γ-aminopropyltriethoxysilane was so diluted with toluene as to be in a concentration of 1.0% by mass. These were mixed to obtain Resin Solution 1.

Preparation of Resin Solution 2

15.0 parts by mass of Copolymer Solution 1 was dissolved in 85.0 parts by mass of toluene to obtain Resin Solution 2.

Preparation of Resin Solution 3

Straight silicone resin (KR255, available from Shin-Etsu Chemical Co., Ltd., was so diluted with toluene as to be in a solid-matter concentration of 15.0% by mass and γ-aminopropyltriethoxysilane was so diluted with toluene as to be in a concentration of 1.0% by mass. These were mixed to obtain Resin Solution 3.

Preparation of Resin Solution 4

15.0 parts by mass of Copolymer Solution 2, 2.0 parts by mass of a quaternary ammonium salt compound (P-51, available from Orient Chemical Industries, Ltd.) were dissolved in 83.0 parts by mass of toluene to obtain Resin Solution 4.

Preparation of Resin Solution 5

13.0 parts by mass of straight silicone resin (SR2411, available from Dow Corning Toray Silicone Co., Ltd.) and 0.5 part by mass of γ-aminopropyltrithoxysilane were dissolved in 86.5 parts by mass of toluene to obtain Resin Solution 5.

Preparation of Resin Solution 6

13.0 parts by mass of straight silicone resin (SR2411, available from Dow Corning Toray Silicone Co., Ltd.) and 2.0 parts by mass of γ-aminopropyltrithoxysilane were dissolved in 100 parts by mass of toluene to obtain Resin Solution 6.

Preparation of Resin Solution 7

20.0 parts by mass of straight silicone resin (SR2411, available from Dow Corning Toray Silicone Co., Ltd.), 2.0 parts by mass of γ-aminopropyltriethoxysilane and 2.0 parts by mass of conductive carbon (KETJEN BLACK EC, available from Ketjen Black International Company) were dissolved in 100 parts by mass of toluene to obtain Resin Solution 7.

Magnetic Carrier Production Example 1

Step 1

Resin Filling Method 1

100.0 parts by mass of Porous Magnetic Cores 1 were put into an agitating container of a mixing agitator (a universal agitator NDMV Model, manufactured by Dulton Company Limited). While keeping its temperature at 30° C. and while producing a vacuum, nitrogen was introduced thereinto, and Resin Solution 1 was dropwise so added under reduced pressure as to be in an amount of 12.0 parts by mass as a resin component, based on the mass of Porous Magnetic Cores 1. After its dropwise addition was completed, the agitation was continued for 2 hours as it was. Thereafter, the temperature was raised to 70° C. and the solvent was removed under reduced pressure, thus Porous Magnetic Cores 1 were filled in their core particles with a silicone resin composition having silicone resin, obtained from Resin Solution 1. After cooling, the porous magnetic cores obtained were moved to a mixing machine having a spiral blade in a rotatable mixing container (a drum mixer UD-AT Model, manufactured by Sugiyama Heavy Industrial Co., Ltd.) to carry out heat treatment at a temperature of 200° C. for 2 hours in an atmosphere of nitrogen, followed by classification with a sieve of 70 μm in mesh opening to obtain magnetic cores filled with the silicone resin composition.

Step 2

Resin Coating Method 1

100.0 parts by mass of the magnetic cores thus obtained were put into a planetary-screw mixing machine (Nauta mixer VN model, manufactured by Hosokawa Micron Corporation), and were agitated while a screw-shaped agitating blade was revolved at 3.5 revolutions per minute and rotated at 100 rotations per minute, where nitrogen was flowed at a flow rate of 0.1 $m^3$/min and, in order to remove the toluene, the system was heated to a temperature of 70° C. under reduced pressure (about 0.01 MPa). Resin Solution 3 was so put thereinto as to be in an amount of 1.0 part by mass as a resin component, based on the mass of the magnetic core particles. As a way of putting it thereinto, a ⅓ portion of the resin solution was first put thereinto to carry out the removal of toluene and the resin coating for 20 minutes. Then, another ⅓ portion of the resin solution was further put thereinto to carry out the removal of toluene and the resin coating for 20 minutes, and still another ⅓ portion of the resin solution was further put thereinto to carry out the removal of toluene and the resin coating for 20 minutes. The coating was in an amount of 1.0 part by mass based on 100 parts by mass of the magnetic core particles. Thereafter, the magnetic carrier particles thus coated with silicone resin were moved to a mixing machine having a spiral blade in a rotatable mixing container (a drum mixer UD-AT Model, manufactured by Sugiyama Heavy Industrial Co., Ltd.) to carry out heat treatment at a temperature of 200° C. for 2 hours in an atmosphere of nitrogen while rotating the mixing container at 10 rotations per minute. The state of resin thickness on the surfaces of the magnetic carrier particles was controlled by carrying out agitation. The magnetic carrier thus obtained was passed through a sieve of 70 μm in mesh opening, followed by classification by means of an air classifier to cut off the part of coarse particles to obtain Magnetic Carrier 1.

Magnetic Carrier Production Example 2

Magnetic Carrier 2 was obtained in the same way as that in Magnetic Carrier Production Example 1 except that, in the step 1 of Magnetic Carrier Production Example 1, Porous Magnetic Cores 1 were changed for Porous Magnetic Cores 2, Resin Solution 3 was changed for Resin Solution 4 and its amount of 12.0 parts by mass was changed to 18.0 parts by mass and that, in the step 2, Resin Solution 3 was changed for Resin Solution 4, the heat treatment at a temperature of 200° C. for 2 hours was changed to heat treatment at a temperature of 100° C. for 2 hours and the air classification was not carried out.

Magnetic Carrier Production Example 3

Magnetic Carrier 3 was obtained in the same way as that in Magnetic Carrier Production Example 1 except that, in the step 1 of Magnetic Carrier Production Example 1, Porous Magnetic Cores 1 were changed for Porous Magnetic Cores 3 and, in the step 2, the air classification was not carried out.

Magnetic Carrier Production Example 4

Magnetic Carrier 4 was obtained in the same way as that in Magnetic Carrier Production Example 1 except that, in the step 1 of Magnetic Carrier Production Example 1, Porous Magnetic Cores 1 were changed for Porous Magnetic Cores 4 and the amount of 12.0 parts by mass for the resin solution was changed to 9.6 parts by mass and that, in the step 2, Resin Solution 3 was changed for Resin Solution 4, the heat treatment at a temperature of 200° C. for 2 hours was changed to heat treatment at a temperature of 100° C. for 2 hours and the air classification was carried out to cut off the part of fine particles.

Magnetic Carrier Production Example 5

Magnetic Carrier 5 was obtained in the same way as that in Magnetic Carrier Production Example 1 except that, in the step 1 of Magnetic Carrier Production Example 1, Porous Magnetic Cores 1 were changed for Porous Magnetic Cores 5 and the amount of 12.0 parts by mass for the resin solution was changed to 8.8 parts by mass and that the step 2 was not carried out and the air classification was not carried out.

Magnetic Carrier Production Example 6

Magnetic Carrier 6 was obtained in the same way as that in Magnetic Carrier Production Example 1 except that, in the step 1 of Magnetic Carrier Production Example 1, Porous Magnetic Cores 1 were changed for Porous Magnetic Cores 6, the temperature of 30° C. for the mixing stirrer was changed to 80° C. and the amount of 12.0 parts by mass for the resin solution was changed to 18.0 parts by mass (resin filling method 2) and that the step 2 was not carried out and the air classification was repeated three times to cut off the part of fine particles.

Magnetic Carrier Production Example 7

Step 1

Resin Filling Method 3

100.0 parts by mass of Porous Magnetic Cores 6 were put into an agitating container of a mixing agitator (a universal agitator NDMV Model, manufactured by Dulton Company Limited). While keeping its temperature at 30° C. and producing a vacuum, nitrogen was introduced thereinto, and Resin Solution 1 was dropwise so added under reduced pressure as to be in an amount of 10.8 parts by mass as a resin component, based on the mass of Porous Magnetic Cores 6. After its dropwise addition was completed, the agitation was continued for 2 hours as it was. Thereafter, the temperature was raised to 70° C. and the solvent was removed under reduced pressure, thus Porous Magnetic Cores were filled in their core particles with a silicone resin composition having silicone resin, obtained from Resin Solution 1. Thereafter, the temperature was dropped to 30° C. and the porous magnetic cores filled with the silicone resin composition having silicone resin were again put into the agitating container of the mixing agitator. While keeping its temperature at 30° C. and producing a vacuum, nitrogen was introduced thereinto, and Resin Solution 1 was dropwise so added under reduced pressure as to be in an amount of 10.8 parts by mass as a resin component, based on the mass of Porous Magnetic Cores 6. After its dropwise addition was completed, the agitation was continued for 2 hours as it was. Thereafter, the temperature was raised to 70° C. and the solvent was removed under reduced pressure, thus the filling the core particles therein with the resin was completed. After cooling, the magnetic carrier particles obtained were moved to a mixing machine having a spiral blade in a rotatable mixing container (a drum mixer UD-AT Model, manufactured by Sugiyama Heavy Industrial Co., Ltd.) to carry out heat treatment at a temperature of 200° C. for 2 hours in an atmosphere of nitrogen, followed by classification with a sieve of 70 μm in mesh opening, and then air classification which was repeated three times to cut off the part of fine particles to obtain Magnetic Carrier 7.

The resin coating step was not carried out.

Magnetic Carrier Production Example 8

Magnetic Carrier 8 was obtained in the same way as that in Magnetic Carrier Production Example 7 except that, in the step 1 of Magnetic Carrier Production Example 7, Porous Magnetic Cores 6 were changed for Porous Magnetic Cores 5 and the amount of 10.8 parts by mass for the resin solution was changed to 4.9 parts by mass and that, when filled with the resin in the second stage, Resin Solution 1 was changed for Resin Solution 3, its amount of 10.8 parts by mass was changed to 4.9 parts by mass and the air classification was not carried out.

Magnetic Carrier Production Example 9

The resin filling step was not carried out, and a resin coating step 2 as shown below was carried out.

Step 2

Resin Coating Method 2

100.0 parts by mass of Porous Magnetic Cores 6 were put into a fluidized bed coating apparatus (SPIR-A-FLOW SFC Model, manufactured by Freund Corporation), and nitrogen kept at a feed air flow of 0.8 $m^3$/min was introduced thereinto, where feed temperature was set at a temperature of 100° C. Its rotor was rotated at 1,000 revolutions per minute. After material temperature came to a temperature of 50° C., Resin Solution 3 was used to start its spraying. Spray rate was set at 3.5 g/min. Coating was carried out until coat resin level came to 2.0 parts by mass based on 100.0 parts by mass of Porous Magnetic Cores 6. After cooling, the like coating was further operated to carry out coating until coat resin level came to 2.0 parts by mass based on 100.0 parts by mass of the porous magnetic cores. Furthermore, heat treatment was carried out at a temperature of 200° C. for 2 hours in an atmosphere of nitrogen while agitating the materials by rotating the mixing container at 10 rotations per minute. The state of resin thickness on the surfaces of the magnetic carrier particles was controlled by carrying out agitation. The magnetic carrier thus obtained was passed through a sieve of 70 μm in mesh opening, followed by classification by means of an air classifier, which was carried out three times to cut off the part of fine particles to obtain Magnetic Carrier 9.

Magnetic Carrier Production Example 10

Magnetic Carrier 10 was obtained in the same way as that in Magnetic Carrier Production Example 1 except that, in the step 1 of Magnetic Carrier Production Example 1, Porous Magnetic Cores 1 were changed for Porous Magnetic Cores 5 and the amount of 12.0 parts by mass for the resin solution was changed to 7.8 parts by mass and that the step 2 was not carried out and the air classification was carried out once to cut off the part of fine particles.

Magnetic Carrier Production Example 11

Magnetic Carrier 11 was obtained in the same way as that in Magnetic Carrier Production Example 9 except that, in the step 2 of Magnetic Carrier Production Example 9, the temperature of 100° C. for feed temperature was changed to a temperature of 70° C. and the air classification was carried out five times to cut off the part of coarse particles.

Magnetic Carrier Production Example 12

Magnetic Carrier 12 was obtained in the same way as that in Magnetic Carrier Production Example 1 except that, in the step 1 of Magnetic Carrier Production Example 1, Porous Magnetic Cores 1 were changed for Porous Magnetic Cores 5 and the amount of 12.0 parts by mass for the resin solution was changed to 6.8 parts by mass and the 10 rotations of agitation by the mixing machine having a spiral blade was changed to 20 rotations and that the step 2 was not carried out and the air classification was carried out once to cut off the part of fine particles. Control was strengthened to lessen the resin level on the surfaces of the magnetic carrier particles.

Magnetic Carrier Production Example 13

Magnetic Carrier 13 was obtained in the same way as that in Magnetic Carrier Production Example 6 except that, in the step 1 of Magnetic Carrier Production Example 6, the amount of 18.0 parts by mass for the resin solution used was changed to 19.0 parts by mass and the 10 rotations of agitation by the mixing machine having a spiral blade was changed to 2 rotations and that the air classification was carried out three times to cut off the part of coarse particles. The resin level on the surfaces of the magnetic carrier particles was not controlled.

Magnetic Carrier Production Example 14

Step 1

Resin Filling Method 1

100.0 parts by mass of Porous Magnetic Cores 7 were put into a single-spindle indirect heat type dryer (Torusdisc TD Model, manufactured by Hosokawa Micron Corporation). While keeping its temperature at 75° C. while introducing nitrogen thereinto, Resin Solution 5 was dropwise so added as to be in an amount of 9.6 parts by mass as a resin component, based on the mass of Porous Magnetic Cores 7. After its dropwise addition was completed, the agitation was continued for 2 hours as it was. Thereafter, the temperature was raised to 200° C. and the solvent was removed under reduced pressure. Thereafter, the porous magnetic cores obtained were moved to a mixing machine having a spiral blade, and agitated at 10 rotations per minute to carry out heat treatment at 200° C. for 2 hours while introducing nitrogen thereinto, followed by classification with a sieve of 70 μm in mesh opening to obtain porous magnetic cores filled with the silicone resin composition.

Step 2

Resin Coating Method 3

100.0 parts by mass of the porous magnetic cores thus obtained were put into a fluidized bed coating apparatus (SPIR-A-FLOW SFC Model, manufactured by Freund Corporation), and nitrogen kept at a feed air flow of 0.8 $m^3$/min was introduced thereinto, where feed temperature was set at a temperature of 70° C. Its rotor was rotated at 1,000 revolutions per minute. After material temperature came to a temperature of 50° C., Resin Solution 5 was used to start its spraying. Spray rate was set at 3.5 g/min. Coating was carried out until coat resin level came to 2.0 parts by mass based on 100.0 parts by mass of the porous magnetic cores filled with the silicone resin composition. After the coating, the coated particles were moved to a mixing machine having a spiral blade, and agitated at 10 rotations per minute to carry out heating at 220° C. for 2 hours while introducing nitrogen thereinto, followed by classification with a sieve of 70 μm in mesh opening to obtain Magnetic Carrier 14.

Magnetic Carrier Production Example 15

Magnetic Carrier 15 was obtained in the same way as that in Magnetic Carrier Production Example 1 except that, in the step 1 of Magnetic Carrier Production Example 1, Porous Magnetic Cores 1 were changed for Porous Magnetic Cores 8, the step 1 was not carried out, Resin Solution 3 used in the step 2 was changed for Resin Solution 4 and the air classification was carried out twice to cut off the part of fine particles.

Magnetic Carrier Production Example 16

Magnetic Carrier 16 was obtained in the same way as that in Magnetic Carrier Production Example 14 except that, in Magnetic Carrier Production Example 14, Porous Magnetic Cores 7 were changed for Porous Magnetic Cores 9, Resin Solution 5 was changed for Resin Solution 6, its amount of 9.6 parts by mass was changed to 20.0 parts by mass and the 10 rotations of agitation by the mixing machine having a spiral blade was changed to 2 rotations and that the step 2 was not carried out and the air classification was not carried out.

Magnetic Carrier Production Example 17

Magnetic Carrier 17 was obtained in the same way as that in Magnetic Carrier Production Example 14 except that, in Magnetic Carrier Production Example 14, Porous Magnetic Cores 7 were changed for Porous Magnetic Cores 9, Resin Solution 5 was changed for Resin Solution 6, its amount of 9.6 parts by mass was changed to 13.0 parts by mass and the 10 rotations of agitation by the mixing machine having a spiral blade was changed to 2 rotations and that Resin Solution 5 used in the step 2 was changed for Resin Solution 7 and further the mixing machine for heat treatment after the coating was changed for a vacuum dryer to carry out treatment at a temperature of 220° C. for hours under reduced pressure (about 0.01 MPa) while flowing nitrogen at a flow rate of 0.01 $m^3$/min.

Magnetic Carrier Production Example 18

Step 2

Resin Coating Method 4

100.0 parts by mass of the magnetic cores filled with the silicone resin composition, produced in the step 1 of Magnetic Carrier Production Example 1 were put into a planetary-screw mixing machine (Nauta mixer VN model, manufactured by Hosokawa Micron Corporation), and were agitated while a screw-shaped agitating blade was revolved at 3.5 revolutions per minute and rotated at 100 rotations per minute, where nitrogen was flowed at a flow rate of 0.1 $m^3$/min and, in order to further remove the toluene, the system was heated to a temperature of 70° C. in the state of coming under reduced pressure (about 0.01 MPa). Resin Solution 3 was so put thereinto at one time as to be in an amount of 1.0 part by mass as a resin component, based on the mass of the magnetic carrier particles, to carry out the removal of toluene and the resin coating for 60 minutes. Except for these, the procedure for Magnetic Carrier 1 was repeated to obtain Magnetic Carrier 18.

The filling and coating methods, the type of the resin and the amount of the resin of Magnetic Carriers 1 to 18 each are shown in Table 2.

TABLE 2

| | Core particles | Step 1 | | | Step2 | | |
|---|---|---|---|---|---|---|---|
| Magnetic Carrier No. | Porous Magnetic Cores No. | Filling method | Type of resin | Amount (in terms of resin) | Coating method | Type of resin | Amount (in terms of resin) |
| 1 | 1 | Filling 1 | Resin Sol. 1 | 12.0 pbm | Coating 1 | Resin Sol. 3 | 1.0 pbm |
| 2 | 2 | Filling 1 | Resin Sol. 2 | 18.0 pbm | Coating 1 | Resin Sol. 4 | 1.0 pbm |
| 3 | 3 | Filling 1 | Resin Sol. 1 | 12.0 pbm | Coating 1 | Resin Sol. 3 | 1.0 pbm |
| 4 | 4 | Filling 1 | Resin Sol. 1 | 9.6 pbm | Coating 1 | Resin Sol. 4 | 1.0 pbm |

TABLE 2-continued

| Magnetic Carrier No. | Core particles: Porous Magnetic Cores No. | Step 1: Filling method | Step 1: Type of resin | Step 1: Amount (in terms of resin) | Step2: Coating method | Step2: Type of resin | Step2: Amount (in terms of resin) |
|---|---|---|---|---|---|---|---|
| 5 | 5 | Filling 1 | Resin Sol. 1 | 8.8 pbm | Step 2 was not carried out. | | |
| 6 | 6 | Filling 2 | Resin Sol. 1 | 18.0 pbm | Step 2 was not carried out. | | |
| 7 | 6 | Filling 3 | Resin Sol. 1 | 21.6 pbm | Step 2 was not carried out. | | |
| 8 | 5 | Filling 3 | Resin Sol. 1, 3 | 9.8 pbm | Step 2 was not carried out. | | |
| 9 | 6 | Step 1 was not carried out. | | | Coating 2 | Resin Sol. 3 | 2.0 pbm |
| 10 | 5 | Filling 1 | Resin Sol. 1 | 7.8 pbm | Step 2 was not carried out. | | |
| 11 | 6 | Step 1 was not carried out. | | | Coating 2 | Resin Sol. 3 | 2.0 pbm |
| 12 | 5 | Filling 1 | Resin Sol. 1 | 6.8 pbm | Step 2 was not carried out. | | |
| 13 | 6 | Filling 2 | Resin Sol. 1 | 19.0 pbm | Step 2 was not carried out. | | |
| 14 | 7 | Filling 4 | Resin Sol. 5 | 9.6 pbm | Coating 3 | Resin Sol. 5 | 2.0 pbm |
| 15 | 8 | Step 1 was not carried out. | | | Coating 1 | Resin Sol. 4 | 1.0 pbm |
| 16 | 9 | Filling 4 | Resin Sol. 6 | 20.0 pbm | Step 2 was not carried out. | | |
| 17 | 9 | Filling 4 | Resin Sol. 6 | 13.0 pbm | Coating 3 | Resin Sol. 7 | 2.0 pbm |
| 18 | 1 | Filling 1 | Resin Sol. 1 | 12.0 pbm | Coating 4 | Resin Sol. 3 | 1.0 pbm |

pbm: part(s) by mass

Physical properties of the magnetic carrier and measurement results obtained by calculation according to the method of measuring the resin thickness found by measuring the distance from the surface of the magnetic carrier particle to the surface of the porous magnetic core particle in cross section of the magnetic carrier particles are shown in Table 3.

Actual measurements of the numbers A and B of straight lines in Magnetic Carrier 1 are shown in FIG. 5. FIG. 5 shows as abscissa the number of straight lines that divide a cross section of the magnetic carrier particle equally into 72 at intervals of 5°, drawn from a reference point of the cross section thereof toward the surface of the magnetic carrier particle (straight lines from the reference point: the 1st line is set along Rx), and as ordinate the resin thickness found by measuring the distance from the surface of the magnetic carrier particle to the surface of the porous magnetic core particle on that straight lines. In this graph, A is the number of straight lines along which the values on ordinate are from 0.0 μm or more to 0.3 μm or less and B is the number of straight lines along which the values on ordinate are from 1.5 μm or more to 5.0 μm or less. Also, C is the number of straight lines along which the values on ordinate are from 0.0 μm or more to 5.0 μm or less.

Toner Production Example 1

The following materials were weighed out into a reaction vessel provided with a cooling tube, a stirrer and a nitrogen feed tube.

| | |
|---|---|
| Terephthalic acid | 299 parts by mass |
| Trimellitic anhydride | 19 parts by mass |
| Polyoxypropylene(2.2)-2,2-bis(4-hydroxyphenyl)propane | 747 parts by mass |
| Titanium dihydroxybis(triethanol aminate) | 1 part by mass |

Thereafter, these were heated to a temperature of 200° C., and allowed to react for 10 hours while introducing nitrogen thereinto and while removing the water being formed. Thereafter, at a pressure reduced to $1.3\times10^2$ Pa, these were allowed to react for 1 hour to synthesize Resin 1. Resin 1 had molecular weight as determined by GPC, of 6,000 in weight average molecular weight (Mw), 2,400 in number average molecular weight (Mn) and 2,800 in peak molecular weight (Mp).

The following materials were weighed out into a reaction vessel provided with a cooling tube, a stirrer and a nitrogen feed tube.

| | |
|---|---|
| Terephthalic acid | 332 parts by mass |
| Polyoxyethylene(2.2)-2,2-bis(4-hydroxyphenyl)propane | 996 parts by mass |
| Titanium dihydroxybis(triethanol aminate) | 1 part by mass |

Thereafter, these were heated to a temperature of 220° C., and allowed to react for 10 hours while introducing nitrogen thereinto and while removing the water being formed. With further addition of 96 parts by mass of trimellitic anhydride, these were heated to a temperature of 180° C., and allowed to react for 2 hours to synthesize Resin 2. Resin 2 had molecular weight as determined by GPC, of 84,000 in weight average molecular weight (Mw), 6,200 in number average molecular weight (Mn) and 12,000 in peak molecular weight (Mp), and had a glass transition temperature (Tg) of 62° C.

| | |
|---|---|
| Resin 1 | 50.0 parts by mass |
| Resin 2 | 50.0 parts by mass |
| Purified normal paraffin wax (peak temperature of DSC maximum endothermic peak: 70° C.) | 5.0 parts by mass |
| C.I. Pigment Blue 15:3 | 5.0 parts by mass |
| 3,5-Di-tert-butylsalicylic acid aluminum compound | 1.0 part by mass |

The above materials were mixed using Henschel mixer (FM-75 Model, manufactured by Mitsui Miike Engineering Corporation). Thereafter, the mixture obtained was kneaded by means of a twin-screw kneader (PCM-30 Model, manufactured by Ikegai Corp.) set to a temperature of 130° C. The kneaded product obtained was cooled, and then crushed by means of a hammer mill to a size of 1 mm or less to obtain a crushed product. The crushed product obtained was then finely pulverized by means of an impact air grinding machine making use of high-pressure air.

Next, the finely pulverized product obtained was subjected to surface modification by means of the surface modifying apparatus shown in FIG. 1. Conditions at the time of surface modification are as follows: Feed rate of raw-materials from the auto-feeder 2 was 2.0 kg/hr, emission temperature of hot air from the hot-air flow-in opening 5 was 220° C. and emission temperature of cold air from the cold-air flow-in opening 6 was −5° C., under conditions of which the surface modification was carried out. Next, the surface-modified product obtained was classified by means of an air classifier utilizing the Coanda effect (Elbow Jet Labo EJ-L3, manufactured by Nittetsu Mining Co., Ltd.) to classify and remove fine powder and coarse powder simultaneously to obtain toner particles.

100.0 parts by mass of the toner particles obtained were mixed with, as inorganic fine powders, 1.0 part by mass of fine titanium oxide powder having a number average particle diameter of 40 nm and having been treated with isobutyltrimethoxysilane to have a degree of hydrophobicity of 50% and 0.5 part by mass of fine amorphous silica powder having a number average particle diameter of 110 nm and having been treated with hexamethyldisilazane to have a degree of hydrophobicity of 85%, by external addition to obtain Toner 1.

Toner Production Example 2

In Toner Production Example 1, 2.0 parts by mass of rice wax (peak temperature of DSC maximum endothermic peak: 79° C.) was used in place of 5.0 parts by mass of the purified normal paraffin wax (peak temperature of DSC maximum endothermic peak: 70° C.). The finely pulverized product obtained was, without making any surface modification, classified by means of the air classifier (Elbow Jet Labo EJ-L3, manufactured by Nittetsu Mining Co., Ltd.) to classify and remove fine powder and coarse powder simultaneously. Except for the above, the procedure of Toner Production Example 1 was repeated to obtain Toner 2.

Toner Production Example 3

| | |
|---|---|
| Styrene | 78.4 parts by mass |
| n-Butyl acrylate | 20.8 parts by mass |
| Methacrylic acid | 2.0 parts by mass |

The above materials were put into a reaction vessel, and the liquid mixture formed was heated to a temperature of 110° C. In an atmosphere of nitrogen, a solution prepared by dissolving 1 part of a radical polymerization initiator tert-butyl hydroperoxide in 10 parts of xylene was dropwise added to the liquid mixture over a period of about 30 minutes. Furthermore, at that temperature, this liquid mixture was kept heated for 10 hours to complete radical polymerization reaction. Furthermore heating this liquid mixture, the pressure was reduced to remove the solvent to obtain Resin 3. Resin 3 had molecular weight as determined by GPC, of 35,000 in weight average molecular weight (Mw), 8,000 in number average molecular weight (Mn) and 12,000 in peak molecular weight (Mp), and had a glass transition temperature (Tg) of 58° C.

| | |
|---|---|
| Resin 2 | 100.0 parts by mass |
| Purified normal paraffin wax (peak temperature of DSC maximum endothermic peak: 70° C.) | 5.0 parts by mass |
| C.I. Pigment Blue 15:3 | 5.0 parts by mass |
| 3,5-Di-tert-butylsalicylic acid aluminum compound | 1.0 part by mass |

The above materials were well mixed using Henschel mixer (FM-75 Model, manufactured by Mitsui Miike Engineering Corporation). Thereafter, the mixture obtained was kneaded by means of a twin-screw kneader (PCM-30 Model, manufactured by Ikegai Corp.) set to a temperature of 130° C. The kneaded product obtained was cooled, and then crushed by means of a hammer mill to a size of 1 mm or less to obtain a crushed product. The crushed product obtained was then finely pulverized by means of an impact air grinding machine making use of high-pressure air.

Next, the finely pulverized product obtained was subjected to surface modification while removing fine particles, by using FACULTY (manufactured by Hosokawa Micron Corporation) to obtain toner particles.

100.0 parts by mass of the toner particles obtained were mixed with, as inorganic fine powders, 1.0 part by mass of fine titanium oxide powder having a number average particle diameter of 40 nm and having been treated with isobutyltrimethoxysilane to have a degree of hydrophobicity of 50% and 0.5 part by mass of fine amorphous silica powder having a number average particle diameter of 110 nm and having been treated with hexamethyldisilazane to have a degree of hydrophobicity of 85%, by external addition to obtain Toner 3.

Toner Production Example 4

Into 710 parts by weight of ion-exchanged water, 450 parts by mass of an aqueous 0.1M $Na_3PO_4$ solution was introduced. The mixture formed was heated to a temperature of 65° C., and thereafter stirred at 200 $s^{-1}$ (12,000 rpm) by means of a TK-type homomixer (manufactured by Tokushu Kika Kogyo Co., Ltd.). Then, 68 parts by mass of an aqueous 1.0M $CaCl_2$ solution was slowly added thereto to obtain an aqueous medium containing $Ca_3(PO_4)_2$.

| | |
|---|---|
| Styrene | 80.0 parts by mass |
| n-Butyl acrylate | 20.0 parts by mass |
| C.I. Pigment Blue 15:3 | 6.0 parts by mass |
| 3,5-Di-t-butylsalicylic acid aluminum compound | 1.0 part by mass |
| Polyester resin (polymerized from bisphenol A, terephthalic acid and trimellitic anhydride; Mp: 8,000) | 7.0 parts by mass |
| Behenyl behenate (peak temperature of DSC maximum endothermic peak: 72° C.) | 14.0 parts by mass |

The above materials were heated to a temperature of 60° C. and were uniformly dissolved or dispersed at 167 $s^{-1}$ (10,000) rpm by means of a TK-type homomixer (manufactured by Tokushu Kika Kogyo Co., Ltd.). In the dispersion obtained, 7.0 parts by mass of a polymerization initiator 2,2'-azobis(2,4-dimethylvaleronitrile) was dissolved to prepare a monomer composition.

The monomer composition was introduced into the above aqueous medium and then stirred at 167 $s^{-1}$ (10,000 rpm) for 10 minutes by means of the TK-type homomixer at a temperature of 60° C. in an atmosphere of $N_2$ to granulate the monomer composition. Thereafter, with stirring using paddle stirring blades, the temperature was raised to 80° C. to carry out the reaction for 10 hours. After the polymerization reaction was completed, residual monomers were evaporated off under reduced pressure and the reaction mixture was cooled. Thereafter, hydrochloric acid was added to dissolve the $Ca_3(PO_4)_2$ and so forth, followed by filtration, water washing and drying to obtain toner particles.

100.0 parts by mass of the toner particles obtained were mixed with, as inorganic fine powders, 1.0 part by mass of fine titanium oxide powder having a number average particle diameter of 40 nm and having been treated with isobutyltrimethoxysilane to have a degree of hydrophobicity of 50% and 0.5 part by mass of fine amorphous silica powder having a number average particle diameter of 110 nm and having been treated with hexamethyldisilazane to have a degree of hydrophobicity of 85%, by external addition to obtain Toner 4. Toner 4 had molecular weight as determined by GPC, of 210,000 in weight average molecular weight (Mw), 7,000 in number average molecular weight (Mn) and 31,000 in peak molecular weight (Mp).

Toner Production Example 5

Dispersion A

| | |
|---|---|
| Styrene | 350.0 parts by mass |
| n-Butyl acrylate | 100.0 parts by mass |
| Acrylic acid | 25.0 parts by mass |
| t-Dodecyl mercaptan | 10.0 parts by mass |

The above materials were mixed and dissolved to prepare a monomer mixture A.

| | |
|---|---|
| Paraffin wax dispersion (peak temperature of DSC maximum endothermic peak: 72° C.; solid-matter concentration: 30%; dispersed-particle diameter: 0.14 μm) | 100.0 parts by mass |
| Anionic surface-active agent (NEOGEN SC, available from Dai-ichi Kogyo Seiyaku Co., Ltd.) | 1.2 parts by mass |
| Nonionic surface-active agent (NONIPOL 400, available from Sanyo Chemical Industries, Ltd.) | 0.5 part by mass |
| Ion-exchanged water | 1,530 parts by mass |

The above materials were put into a flask and made to disperse, and were started to be heated while making displacement by nitrogen. At the time the liquid temperature came to a temperature of 65° C., a solution prepared by dissolving 6.5 parts by mass of potassium persulfate in 350 parts by mass of ion-exchanged water was put into this liquid. While keeping the liquid temperature at a temperature of 70° C., the monomer mixture A was put thereinto and stirred, where the liquid temperature was raised to a temperature of 80° C. and emulsion polymerization was continued for 5 hours as it was, and thereafter the liquid temperature was set to a temperature of 40° C., followed by filtration with a filter to obtain a dispersion A.

Dispersion B

| | |
|---|---|
| Styrene | 350.0 parts by mass |
| n-Butyl acrylate | 100.0 parts by mass |
| Acrylic acid | 30.0 parts by mass |

The above materials were mixed and dissolved to prepare a monomer mixture B.

| | |
|---|---|
| Fischer-Tropsch wax dispersion (peak temperature of DSC maximum endothermic peak: 105° C.; solid-matter concentration: 30%; dispersed-particle diameter: 0.15 μm) | 100.0 parts by mass |
| Anionic surface-active agent (NEOGEN SC, available from Dai-ichi Kogyo Seiyaku Co., Ltd.) | 1.5 parts by mass |
| Nonionic surface-active agent (NONIPOL 400, available from Sanyo Chemical Industries, Ltd.) | 0.5 part by mass |
| Ion-exchanged water | 1,530 parts by mass |

The above materials were put into a flask and made to disperse, and were started to be heated while making displacement by nitrogen. At the time the liquid temperature came to a temperature of 65° C., a solution prepared by dissolving 5.9 parts by mass of potassium persulfate in 300.0 parts by mass of ion-exchanged water was put into this liquid. While keeping the liquid temperature at a temperature of 65° C., the monomer mixture B was put thereinto and stirred, where the liquid temperature was raised to a temperature of 75° C. and emulsion polymerization was continued for 8 hours as it was, and thereafter the liquid temperature was set to a temperature of 40° C., followed by filtration with a filter to obtain a dispersion B.

Dispersion C

| | |
|---|---|
| C.I. Pigment Blue 15:3 | 12.0 parts by mass |
| Anionic surface-active agent (NEOGEN SC, available from Dai-ichi Kogyo Seiyaku Co., Ltd.) | 2.0 parts by mass |
| Ion-exchanged water | 78.0 parts by mass |

The above materials were mixed and then made to disperse by using a sand grinder to obtain a colorant dispersion C.

300.0 parts by mass of the dispersion A, 150.0 parts by mass of the dispersion B and 25.0 parts by mass of the dispersion C were put into a 1 liter separable flask fitted with a stirrer, a condenser and a thermometer, and stirred. To the liquid mixture thus obtained, 180.0 parts by mass of an aqueous 10% by weight sodium chloride solution was dropwise added as an agglomerating agent, and the contents of the flask was stirred in a heating oil bath, during which this was heated to a temperature of 54° C., and this was retained for 1 hour.

In a subsequent fusing step, 3.0 parts by mass of an anionic surface-active agent (NEOGEN SC, available from Dai-ichi Kogyo Seiyaku Co., Ltd.) was added thereto. Thereafter, a flask made of stainless steel was sealed and, with stirring continued using a magnetic seal, heated to a temperature of 100° C., which was retained for 3 hours. Then, after cooling, the reaction product obtained was filtered, and washed sufficiently with ion-exchanged water, followed by drying to obtain toner particles.

100.0 parts by mass of the toner particles obtained were mixed with, as inorganic fine powders, 1.0 part by mass of fine titanium oxide powder having a number average particle diameter of 40 nm and having been treated with isobutyltrimethoxysilane to have a degree of hydrophobicity of 50% and 0.5 part by mass of fine amorphous silica powder having a number average particle diameter of 110 nm and having been treated with hexamethyldisilazane to have a degree of hydrophobicity of 85%, by external addition to obtain Toner 5. Toner 5 had molecular weight as determined by GPC, of 870,000 in weight average molecular weight (Mw), 8,000 in number average molecular weight (Mn) and 19,000 in peak molecular weight (Mp).

Examples 1 to 14 & Comparative Examples 1 to 8

Using the magnetic carriers and toners produced, two-component developers were prepared in the combinations shown in Table 3. The two-component developers were each prepared in a blend proportion of 90% by mass of the magnetic carrier and 10% by mass of the toner.

FFH images (solid areas). The FFH images refer to a value which indicates 256 gradations by 16-adic number, regarding OOH as the 1st gradation (white background) and FFH as the 256th gradation (solid areas).

After it was so controlled, FFH images of 3 cm×6 cm in size were reproduced on one sheet, and this was taken as initial-stage images. About such initial-stage images, their image density was judged by using X-Rite color reflection densitometer (Color Reflection Densitometer X-Rite 404A).

Subsequently, FFH images of 1% in image percentage were reproduced on 50,000 sheets. After their reproduction,

TABLE 3

| | Magnetic Carrier | | | | | | | | | | | Toner | | | |
|---|---|---|---|---|---|---|---|---|---|---|---|---|---|---|---|
| | No. | D50 (μm) | A (lines) | B (lines) | Maximum of average value (μm) | Minimum of average value (μm) | Difference between maximum and minimum | Standard deviation (μm) | C (lines) | Proportion satisfying Rx/Ry ≦ 1.2 (%) | *Proportion | No. | D4 (μm) | average circularity | Cumulative 10% by number |
| Example: | | | | | | | | | | | | | | | |
| 1 | 1 | 33.8 | 25 | 18 | 1.4 | 0.6 | 0.8 | 0.8 | 72 | 100 | 100 | 1 | 5.8 | 0.959 | 0.935 |
| 2 | 1 | 33.8 | 25 | 18 | 1.4 | 0.6 | 0.8 | 0.8 | 72 | 100 | 100 | 3 | 5.6 | 0.948 | 0.928 |
| 3 | 1 | 33.8 | 25 | 18 | 1.4 | 0.6 | 0.8 | 0.8 | 72 | 100 | 100 | 4 | 7.2 | 0.980 | 0.960 |
| 4 | 1 | 33.8 | 25 | 18 | 1.4 | 0.6 | 0.8 | 0.8 | 72 | 100 | 100 | 5 | 6.2 | 0.965 | 0.945 |
| 5 | 2 | 36.2 | 17 | 23 | 1.4 | 0.7 | 0.7 | 1.2 | 71 | 100 | 96 | 1 | 5.8 | 0.959 | 0.935 |
| 6 | 3 | 35.2 | 16 | 15 | 1.2 | 0.5 | 0.7 | 0.6 | 72 | 100 | 96 | 1 | 5.8 | 0.959 | 0.935 |
| 7 | 4 | 39.4 | 28 | 25 | 1.4 | 0.6 | 0.8 | 0.4 | 70 | 100 | 92 | 1 | 5.8 | 0.959 | 0.935 |
| 8 | 5 | 35.2 | 29 | 16 | 1.4 | 0.5 | 0.9 | 0.3 | 72 | 100 | 92 | 1 | 5.8 | 0.959 | 0.935 |
| 9 | 6 | 43.2 | 13 | 29 | 1.3 | 0.7 | 0.6 | 1.3 | 72 | 96 | 88 | 1 | 5.8 | 0.959 | 0.935 |
| 10 | 7 | 48.5 | 12 | 14 | 1.5 | 0.6 | 0.9 | 0.8 | 72 | 100 | 92 | 1 | 5.8 | 0.959 | 0.935 |
| 11 | 8 | 37.5 | 24 | 28 | 1.5 | 0.9 | 0.6 | 0.5 | 71 | 96 | 88 | 1 | 5.8 | 0.959 | 0.935 |
| 12 | 9 | 45.2 | 11 | 33 | 1.3 | 0.5 | 0.8 | 0.6 | 71 | 96 | 84 | 1 | 5.8 | 0.959 | 0.935 |
| 13 | 10 | 38.5 | 33 | 9 | 1.7 | 0.1 | 1.6 | 1.6 | 72 | 96 | 72 | 1 | 5.8 | 0.959 | 0.935 |
| 14 | 11 | 22.5 | 8 | 8 | 0.6 | 0.5 | 0.1 | 0.2 | 72 | 96 | 68 | 1 | 5.8 | 0.959 | 0.935 |
| Comparative Example: | | | | | | | | | | | | | | | |
| 1 | 12 | 40.5 | 37 | 6 | 1.8 | 0.2 | 1.6 | 1.7 | 72 | 100 | 12 | 1 | 5.8 | 0.959 | 0.935 |
| 2 | 13 | 25.8 | 6 | 37 | 1.7 | 0.1 | 1.6 | 1.6 | 68 | 100 | 8 | 1 | 5.8 | 0.959 | 0.935 |
| 3 | 14 | 36.4 | 6 | 6 | 0.5 | 0.4 | 0.1 | 0.2 | 72 | 96 | 4 | 1 | 5.8 | 0.959 | 0.935 |
| 4 | 15 | 40.3 | 4 | 41 | 1.8 | 0.2 | 1.6 | 1.4 | 67 | 93 | 4 | 1 | 5.8 | 0.959 | 0.935 |
| 5 | 12 | 40.5 | 37 | 6 | 1.8 | 0.2 | 1.6 | 1.7 | 72 | 100 | 12 | 2 | 4.8 | 0.934 | 0.908 |
| 6 | 16 | 36.9 | 4 | 30 | 1.9 | 0.4 | 1.5 | 1.4 | 64 | 96 | 4 | 1 | 5.8 | 0.959 | 0.935 |
| 7 | 17 | 35.4 | 5 | 6 | 0.6 | 0.4 | 0.2 | 0.2 | 72 | 100 | 8 | 1 | 5.8 | 0.959 | 0.935 |
| 8 | 1 | 34.0 | 20 | 6 | 1.3 | 0.4 | 0.9 | 0.9 | 72 | 96 | 92 | 1 | 5.8 | 0.959 | 0.935 |

*Proportion of magnetic carrier particles the A, B and C of which satisfy the ranges specified in the present invention, to the whole magnetic carrier (% by number)

A color copying machine iRC6800, manufactured by CANON INC., was used as an image forming apparatus and a cyan color developing assembly was used, which was so converted that the rotational direction of its developer carrying member was in the regular direction to its photosensitive member in the developing zone. As conditions for development, it was so converted that the distance at a development pole between the developing sleeve and the photosensitive member (S-D distance) was 300 μm and the peripheral speed of the developing sleeve was 1.8 times that of the photosensitive member. Then, an AC voltage of 2.0 kHz in frequency and 1.5 kV in peak-to-peak voltage (Vpp) and a DC voltage $V_{cc}$ were applied to the developing sleeve.

Image Reproduction Environment

Temperature 23° C./humidity 60% RH (hereinafter "N/N").
Temperature 23° C./humidity 5% RH (hereinafter "N/L").
Temperature 30° C./humidity 80% RH (hereinafter "H/H").
Paper: Paper for laser beam printers CS-814 (A4, 81.4 g/m$^2$; available from Canon Marketing Japan Inc.).

Density Variations in Image Reproduction Running

In each environment, the DC voltage $V_{cc}$ was so controlled that the toner laid-on level on paper came to 0.5 mg/cm$^2$ for FFH images of 3 cm×6 cm in size were reproduced on one sheet, and this was taken as images after running. About the images after running, their image density was judged by using the reflection densitometer in the same way as that in the initial stage, and a difference between this density and the initial-stage density was calculated as an absolute value.

A: From 0.00 or more to less than 0.05.

B: From 0.05 or more to less than 0.10.

C: From 0.10 or more to less than 0.20.

D: 0.20 or more.

Carrier Sticking

The DC voltage $V_{cc}$ was so controlled that the toner laid-on level on paper came to 0.5 mg/cm$^2$ for FFH images (solid areas). Next, FFH images of 1% in image area percentage were reproduced on 50,000 sheets. Thereafter, 00H images were reproduced, and a transparent pressure-sensitive tape was brought into close contact with the surface of the photosensitive drum to make sampling, where the number of magnetic carrier particles having come to stick to the surface of the photosensitive drum in its area of 1 cm×1 cm was counted to calculate the number of sticking magnetic carrier particles per 1 $Cm^2$.

A: 3 particles or less.

B: From 4 particles or more to 10 particles or less.

C: From 11 particles or more to 20 particles or less.

D: 21 particles or more.

Blank Areas

In each environment, FFH images of 5% in image percentage were reproduced on 10 sheets. A chart was reproduced in which horizontal zones (10 mm in width) of 30H images and horizontal zones (10 mm in width) of FFH images were alternately arranged in the direction of transport of paper. The images formed were read with a scanner, and were binary-coded. Luminance distribution (256 gradations) of a certain line present in the direction of transport of the binary-coded images was taken, where a tangent line is drawn to the luminance of 30H images at that point, and the region of luminance (area: the sum of number of luminance) shifted from a tangent line at the rear end of a 30H image area which region extends until it intersects the luminance of FFH images is regarded as the degree of blank areas.

A: 50 or less.

B: From 51 or more to 150 or less.

C: From 151 or more to 300 or less.

D: 301 or more.

Fog After Leaving

In each environment, FFH images of 5% in image percentage were reproduced on 10 sheets. After the copying machine main body was left for a week in each environment, 00H images were reproduced on one sheet. Average reflectance Dr (%) on paper was measured with a reflection densitometer (REFLECTOMETER MODEL TC-6DS, manufactured by Tokyo Denshoku Co., Ltd.). Subsequently, reflectance Ds (%) of the 00H image was measured. Fog percentage (%) was calculated according to the following equation. The fog thus found was evaluated according to the following evaluation criteria.

$$\text{Fog percentage}(\%)=Dr(\%)-Ds(\%).$$

A: 0.5% or less.

B: From 0.6% or more to 1.0% or less.

C: From 1.1% or more to 2.0% or less.

D: 2.1% or more.

The results of evaluation on the foregoing are each shown in Table 4.

TABLE 4

Results of Evaluation in N/N, N/L & H/H Environments

| | Image density before running | | | Image density after running | | | Density variations before and after running | | | Carrier sticking after running | | |
|---|---|---|---|---|---|---|---|---|---|---|---|---|
| | N/N | N/L | H/H | N/N | N/L | H/H | N/N | N/L | H/H | N/N | N/L | H/H |
| Example: | | | | | | | | | | | | |
| 1 | 1.52 | 1.50 | 1.53 | 1.51 | 1.47 | 1.52 | A (0.01) | A (0.03) | A (0.01) | A (1) | A (1) | A (1) |
| 2 | 1.54 | 1.52 | 1.54 | 0.52 | 1.48 | 0.52 | A (0.02) | A (0.04) | A (0.02) | A (1) | A (2) | A (1) |
| 3 | 1.55 | 1.53 | 1.54 | 0.52 | 1.50 | 0.53 | A (0.03) | A (0.03) | A (0.01) | A (2) | A (1) | A (2) |
| 4 | 0.53 | 1.52 | 1.53 | 0.51 | 1.48 | 1.52 | A (0.02) | A (0.04) | A (0.01) | A (1) | A (2) | A (3) |
| 5 | 1.48 | 1.45 | 1.47 | 1.47 | 1.42 | 1.46 | A (0.01) | A (0.03) | A (0.01) | A (1) | A (1) | A (1) |
| 6 | 1.45 | 1.42 | 1.46 | 1.42 | 1.38 | 1.44 | A (0.03) | A (0.04) | A (0.02) | A (1) | A (2) | A (3) |
| 7 | 1.46 | 1.45 | 1.47 | 1.42 | 1.39 | 1.44 | A (0.04) | B (0.06) | A (0.03) | A (2) | A (2) | A (1) |
| 8 | 1.48 | 1.45 | 1.49 | 1.44 | 1.40 | 1.48 | A (0.04) | A (0.05) | A (0.01) | A (2) | A (1) | A (2) |
| 9 | 1.50 | 1.48 | 1.52 | 1.46 | 1.41 | 1.51 | A (0.04) | B (0.07) | A (0.01) | A (3) | A (3) | A (2) |
| 10 | 1.48 | 1.44 | 1.51 | 1.45 | 1.40 | 1.49 | A (0.03) | A (0.04) | A (0.02) | C (12) | C (13) | C (14) |
| 11 | 1.43 | 1.42 | 1.48 | 1.34 | 1.30 | 1.44 | B (0.09) | C (0.12) | A (0.04) | B (4) | B (5) | B (6) |
| 12 | 1.46 | 1.45 | 1.45 | 1.37 | 1.32 | 1.41 | B (0.09) | C (0.13) | A (0.04) | A (2) | A (1) | A (3) |
| 13 | 1.53 | 1.52 | 1.46 | 1.49 | 1.48 | 1.43 | A (0.04) | A (0.04) | A (0.03) | C (13) | C (12) | C (11) |
| 14 | 1.48 | 1.45 | 1.52 | 1.45 | 1.41 | 1.50 | A (0.03) | A (0.04) | A (0.02) | C (13) | C (14) | C (15) |
| Comparative Example: | | | | | | | | | | | | |
| 1 | 1.49 | 1.47 | 1.48 | 1.46 | 1.43 | 1.46 | A (0.03) | A (0.04) | A (0.02) | D (21) | D (22) | D (23) |
| 2 | 1.42 | 1.41 | 1.42 | 1.24 | 1.19 | 1.33 | C (0.08) | D (0.22) | B (0.09) | A (3) | A (2) | A (2) |
| 3 | 1.54 | 1.52 | 1.50 | 1.51 | 1.48 | 1.48 | A (0.03) | A (0.04) | A (0.02) | D (23) | D (22) | D (21) |
| 4 | 1.45 | 1.42 | 1.50 | 1.26 | 1.19 | 1.41 | C (0.19) | D (0.23) | B (0.09) | A (2) | A (3) | A (3) |
| 5 | 1.38 | 1.35 | 1.40 | 1.31 | 1.26 | 1.36 | B (0.07) | B (0.09) | A (0.04) | D (25) | D (23) | D (24) |
| 6 | 1.28 | 1.20 | 1.39 | 1.21 | 1.12 | 1.33 | B (0.07) | B (0.08) | B (0.06) | B (4) | A (3) | B (5) |
| 7 | 1.48 | 1.50 | 1.53 | 1.43 | 1.42 | 1.46 | B (0.05) | B (0.08) | B (0.07) | D (22) | D (21) | D (25) |
| 8 | 1.50 | 1.49 | 1.55 | 1.44 | 1.41 | 1.44 | B (0.06) | B (0.08) | C (0.11) | A (3) | B (9) | C (17) |

| | Blank areas after leaving | | | Fog after leaving | | |
|---|---|---|---|---|---|---|
| | N/N | N/L | H/H | N/N | N/L | H/H |
| Example: | | | | | | |
| 1 | A (13) | A (15) | A (11) | A (0.1) | A (0.1) | A (0.2) |
| 2 | A (14) | A (16) | A (12) | A (0.1) | A (0.2) | A (0.2) |
| 3 | A (8) | A (10) | A (6) | A (0.2) | A (0.2) | A (0.3) |
| 4 | A (12) | A (13) | A (10) | A (0.2) | A (0.2) | A (0.2) |
| 5 | A (11) | A (14) | A (10) | A (0.1) | A (0.1) | A (0.2) |
| 6 | A (10) | A (11) | A (7) | A (0.1) | A (0.1) | A (0.2) |
| 7 | A (11) | A (12) | A (13) | A (0.2) | A (0.1) | A (0.3) |
| 8 | A (27) | B (56) | A (26) | B (0.5) | A (0.4) | B (0.8) |
| 9 | A (35) | B (63) | A (33) | A (0.3) | A (0.2) | A (0.4) |
| 10 | A (42) | B (70) | A (39) | A (0.4) | A (0.3) | A (0.5) |

TABLE 4-continued

| Results of Evaluation in N/N, N/L & H/H Environments | | | | | | |
|---|---|---|---|---|---|---|
| 11 | A (23) | A (34) | A (20) | A (0.4) | A (0.3) | A (0.5) |
| 12 | B (137) | C (163) | A (47) | A (0.4) | A (0.3) | A (0.5) |
| 13 | A (25) | A (40) | A (23) | B (0.8) | B (0.6) | C (1.2) |
| 14 | B (148) | C (185) | A (47) | A (0.4) | A (0.3) | A (0.5) |
| Comparative Example: | | | | | | |
| 1 | A (28) | A (46) | A (25) | C (1.1) | B (0.7) | D (2.2) |
| 2 | C (269) | D (316) | B (145) | B (0.6) | B (0.8) | B (1.0) |
| 3 | C (276) | D (356) | B (146) | A (0.4) | A (0.3) | A (0.5) |
| 4 | C (289) | D (390) | B (149) | A (0.4) | A (0.3) | A (0.5) |
| 5 | B (136) | B (147) | B (122) | C (1.2) | B (0.9) | D (2.4) |
| 6 | D (348) | D (706) | D (307) | A (0.5) | A (0.4) | B (0.8) |
| 7 | C (233) | D (302) | C (159) | C (1.8) | B (0.6) | D (3.7) |
| 8 | A (47) | C (103) | A (49) | C (1.1) | B (1.0) | D (2.1) |

The above embodiments are all only those showing examples of embodiment in practicing the present invention, and shall not be those by which the technical scope of the present invention is construed as being restrictive. That is, the present invention may be practiced in various forms without deviation from its technical idea or its main features.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-201072, filed Aug. 4, 2008, which is hereby incorporated by reference herein in its entirety.

What is claimed is:

1. A magnetic carrier which comprises: magnetic carrier particles containing porous magnetic core particles which are filled in pores thereof with a first resin;

wherein the porous magnetic carrier particles filled in pores thereof with the first resin are further coated on the surfaces thereof with a second resin, which is the same or different from the first resin; and wherein 60% by number or more of the magnetic carrier particles satisfies the following (a), (b) and (c) when cross-sectional reflected electron image of the magnetic carrier particle photographed by a SEM is divided into 72 with straight lines drawn from a reference point in a radial fashion towards the surface of the magnetic carrier particle at an interval of 5°;

(a) the number "A" of the straight lines on which the distance from the surface of the magnetic carrier particle to the surface of the porous magnetic core particle is from 0.0 μm or more to 0.3 μm or less, is from 7 lines or more to 36 lines or less, among the 72 straight lines;

(b) the number "B" of the straight lines on which the distance from the surface of the magnetic carrier particle to the surface of the porous magnetic core particle is from 1.5 μm or more to 5.0 μm or less, is from 7 lines or more to 36 lines or less, among the 72 straight lines; and (c) the number "C" of the straight lines on which the distance from the surface of the magnetic carrier particle to the surface of the porous magnetic core particle is from 0.0 μm or more to 5.0 μm or less, is 70 lines or more, among the 72 straight lines.

2. The magnetic carrier according to claim 1, wherein the "A" is from 11 lines or more to 32 lines or less, among the 72 straight lines, and the B is from 11 lines or more to 32 lines or less, among the 72 straight lines.

3. The magnetic carrier according to claim 1, wherein, where an average value of the distance from the surface of the magnetic carrier particle to the surface of the porous magnetic core particle along straight lines of from the 1st line to the 18th line among the 72 straight lines is set as an average value (1), an average value of the distance from the surface of the magnetic carrier particle to the surface of the porous magnetic core particle along straight lines of from the 19th line to the 36th line among the 72 straight lines is set as an average value (2), an average value of the distance from the surface of the magnetic carrier particle to the surface of the porous magnetic core particle along straight lines of from the 37th line to the 54th line among the 72 straight lines is set as an average value (3) and an average value of the distance from the surface of the magnetic carrier particle to the surface of the porous magnetic core particle along straight lines of from the 55th line to the 72nd line among the 72 straight lines is set as an average value (4), a difference between the maximum value and the minimum value in the average values (1) to (4) is 1.5 μm or less.

4. A two-component developer which comprises the magnetic carrier according to claim 1 and a toner.

5. The two-component developer according to claim 4, wherein the toner has an average circularity of from 0.940 or more to 1.000 or less where particles having a circle-equivalent diameter of from 1.985 μm or more to less than 39.69 μm as measured with a flow type particle image analyzer having an image processing resolution of 512×512 pixels (0.37 μm×0.37 μm per pixel) are divided into 800 in the range of circularities of from 0.200 to 1.000 to make analysis.

6. The two-component developer according to claim 4, wherein the toner has a circularity of 0.910 or more at cumulative 10% by number from lower circularities in circularity distribution of particles with a circle-equivalent diameter of from 1.985 μm or more to less than 39.69 μm of the toner.

* * * * *